US010946670B1

(12) United States Patent
Tonchev et al.

(10) Patent No.: US 10,946,670 B1
(45) Date of Patent: Mar. 16, 2021

(54) COMPOSITIONS, APPARATUS, METHODS, AND SUBSTRATES FOR MAKING IMAGES AND TEXT

(71) Applicants: Dan Tonchev, Ottawa (CA); Aref A. Al Salah, Dubai (AE); Maysoon Fehmi Jamal, Dubai (AE)

(72) Inventors: Dan Tonchev, Ottawa (CA); Aref A. Al Salah, Dubai (AE); Maysoon Fehmi Jamal, Dubai (AE)

(73) Assignee: GET GROUP HOLDINGS LIMITED, Dubai (AE)

( * ) Notice: Subject to any disclaimer, the term of this patent is extended or adjusted under 35 U.S.C. 154(b) by 0 days.

(21) Appl. No.: 16/353,142

(22) Filed: Mar. 14, 2019

Related U.S. Application Data

(63) Continuation-in-part of application No. 16/037,286, filed on Jul. 17, 2018, which is a continuation-in-part of application No. 15/725,340, filed on Oct. 5, 2017, which is a continuation-in-part of application No. PCT/IB2016/000547, filed on Apr. 7, 2016.

(60) Provisional application No. 62/405,016, filed on Oct. 6, 2016, provisional application No. 62/145,196, filed on Apr. 9, 2015.

(51) Int. Cl.

| | |
|---|---|
| ***B41J 2/44*** | (2006.01) |
| ***B41J 3/407*** | (2006.01) |
| ***B41J 2/525*** | (2006.01) |

(52) U.S. Cl.
CPC ..... *B41J 2/442* (2013.01); *B41J 2/525* (2013.01); *B41J 3/4073* (2013.01)

(58) Field of Classification Search
None
See application file for complete search history.

(56) References Cited

U.S. PATENT DOCUMENTS

| | | | | |
|---|---|---|---|---|
| 5,234,983 | A * | 8/1993 | Valenty | C08G 18/4045 252/182.2 |
| 5,774,168 | A * | 6/1998 | Blome | B41J 2/475 347/262 |
| 7,158,145 | B1 | 1/2007 | Fannasch et al. | |
| 7,270,943 | B2 * | 9/2007 | Muryama | B41M 5/30 430/337 |
| 7,433,627 | B2 | 10/2008 | German et al. | |
| 8,216,750 | B2 | 7/2012 | Shigemori et al. | |
| 8,379,679 | B2 * | 2/2013 | Zhang | B41M 5/262 372/25 |
| 9,001,173 | B2 | 4/2015 | Lazzari et al. | |
| 2013/0320276 | A1 * | 12/2013 | Farrell | B29C 65/1635 252/582 |

* cited by examiner

*Primary Examiner* — Alejandro Valencia
(74) *Attorney, Agent, or Firm* — Morgan, Lewis & Bockius LLP

(57) ABSTRACT

Embodiments of the present invention feature apparatus and methods for manufacturing a personalized identification document including one or more dyes and/or pigments embedded in the substrate.

22 Claims, 6 Drawing Sheets

SCHEMATIC REPRESENTATION OF THE DESCRIBED LASER COLOR MAKING FOR ID DOCUMENTS - V.1

I - COLOR INK (CMYK) SPREADING ON THE TOP OF THE SUBSTRATE
II - LASER FUSING OF COLORS ON THE IMAGE SIDE, RESIDUAL COLLECTED
III - FIXED COLOR IMAGE ON THE SUBSTRATE

SCHEMATIC REPRESENTATION OF THE ALTERNATIVE COLOR LASER MAKING PROCESS - V.2

I - LASER TREATMENT ON THE SUBSTRATE TO CREATE SPACE OR TRANSFER FROM A DYE RIBBON
II - COLOR INK (CMYK) SPREADING OR TRANSFERRING AND MARKING K(black),
III - HEATED DRUM OR LAMP FUSING OF COLORS ON THE IMAGE SIDE TO DIFFUSE COLOR IMAGE ON THE SUBSTRATE (2nd STEP SUBLIMATED DYE DIFFUSION)

SCHEMATIC REPRESENTATION OF AEROSOL POWDER OR LIQUID COLOR INK LASER COLOR PROCESS -V.3

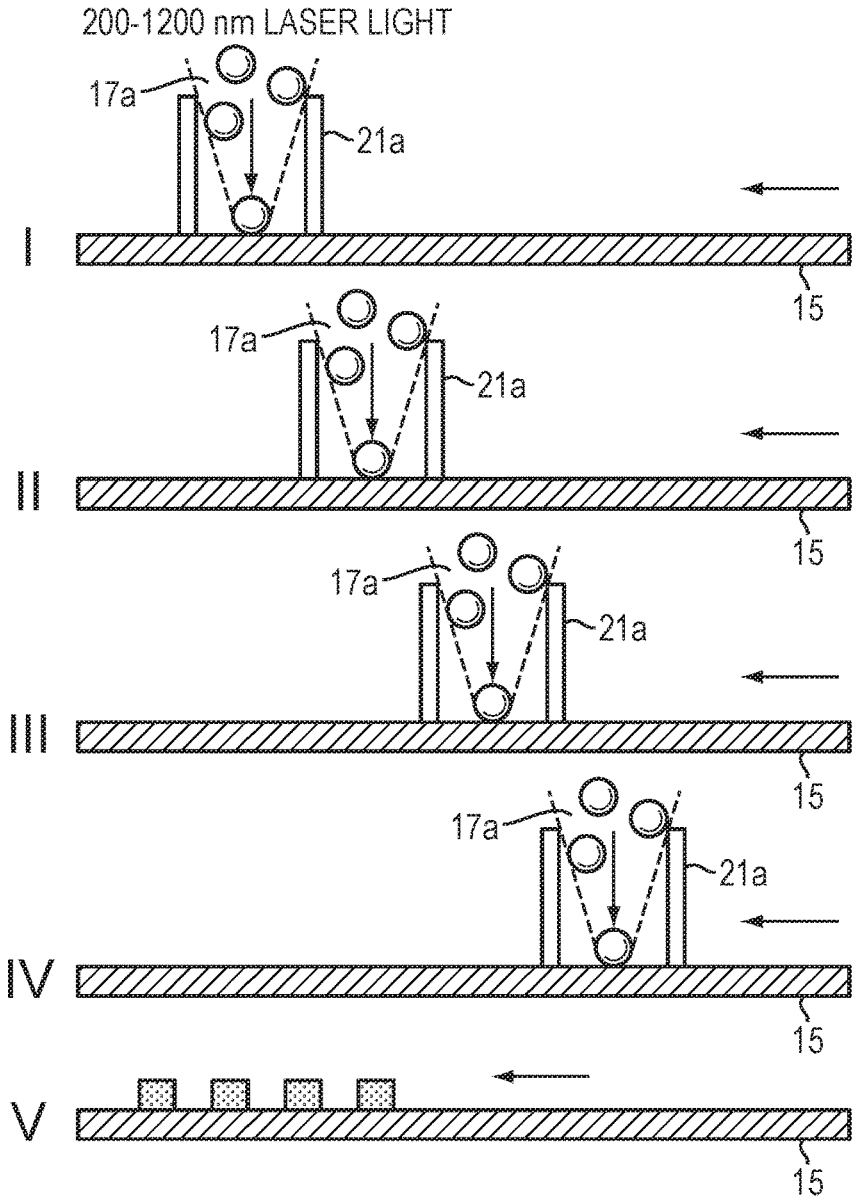

I - LASER FUSING OF BLACK (K) COLOR ON THE SUBSTRATE OUT AEROSOL INK.
II - LASER FUSING OF CYAN (C) COLOR ON THE SUBSTRATE OUT AEROSOL INK.
III - LASER FUSING OF MAGENTA (M) COLOR ON THE SUBSTRATE OUT AEROSOL INK.
IV - LASER FUSING OF YELLOW (Y) COLOR ON THE SUBSTRATE OUT AEROSOL INK.
V - HEATED DRUM OR LAMP FUSING OF COLORS ON THE IMAGE SIDE TO DIFFUSE COLOR IMAGE ON THE SUBSTRATE (2nd STEP SUBLIMATED DYE DIFFUSION)

FIG. 5

COMPOSITIONS, APPARATUS, METHODS, AND SUBSTRATES FOR MAKING IMAGES AND TEXT

RELATED APPLICATIONS

This application is a continuation-in-part of U.S. Ser. No. 16/037,286 (filed on Jul. 17, 2018), which is a continuation-in-part of U.S. patent application Ser. No. 15/725,340 (filed on Oct. 5, 2017), which claims priority to and the benefit of (i) International (PCT) Patent Application Serial No. PCT/IB2016/000547 (filed Apr. 7, 2016), which claims the benefit of U.S. Provisional Patent Application No. 62/145,196 (filed Apr. 9, 2015) and (ii) U.S. Provisional Patent Application No. 62/405,016 (filed Oct. 6, 2016). The entire disclosure of each of these applications is hereby incorporated by reference.

FIELD OF THE INVENTION

Embodiments of the present disclosure are directed to compositions, apparatus, methods and substrates for making images and text. Substrates bearing images and text in accordance with the present disclosure have utility as secure or personalized documents in the nature of passports, identification cards, credit or banking cards and the like.

BACKGROUND OF THE INVENTION

Previous apparatus and methods for document personalization have been inefficient in the sense that most processes subtract or ablate pigments from the surface of a substrate. These processes may not provide images or text of a desired quality.

There is a need to improve quality and efficiency in the making of such secure documents, particularly in color using, for example, a laser source. However, the quality and efficiency of the printing of such documents in color has been limited by various reasons related to the subtractive nature of the process.

Embodiments of the present invention are directed to methods and apparatus for making secure documents in the nature of driver's licenses, passports and other identification documents. Such documents typically have special manufacturing steps which encode visual cues to enable individuals reviewing such to ascertain whether the document is authentic. For example, without limitation, the manufacturing may provide a special background or foreground. The background or foreground may alternatively, or additionally, appear at certain angles of viewing.

These special optical and/or physical features are combined with electronic features and biographical and biometric information. All such features, which create uniqueness in a document, are referred to herein as "document personalization."

SUMMARY OF THE INVENTION

Embodiments of the present disclosure are directed to methods, apparatus, compositions and substrates which can provide manufacturing of a full-color secure document using lasers for improving efficiency and security. One embodiment of the present disclosure is directed to an apparatus for placing an image or text on a substrate. The apparatus includes a means for activating one or more laser sources, such as a near infrared (NIR) laser having a wavelength between 800 nm and 1200 nm, a visible (VIS) laser having a wavelength between 400 nm and 600 nm, and/or an ultraviolet (UV) laser having a wavelength between 200 nm and 400 nm, and applying a formulation to a substrate; the formulation may include one or more binders, one or more reactive polymers, one or more initiators, and one or more pigments (and/or one or more dyes). The substrate can include a composition selected from the group of polymers or mixtures of polymers that are commercially available. The binders have a composition selected from one or more polymers or mixtures of polymers transparent to visible light and different from the substrate. The one or more reactive polymers comprise at least one polymer and/or monomer capable of forming a polymeric mass in the presence of reaction conditions and photoactivation of the initiator by crosslinking. The initiator forms a free radical or/and ion in the presence of photons and the free radical or/and ion capable of initiating polymerization of the reactive polymers. The one or more pigments have a composition selected from the group consisting of inorganic and insoluble hybrid inorganic-organic color products. In some embodiments, dyes are soluble and pre-deposited on an intermediate media (e.g., a ribbon), and the pigments are organic color products.

In an embodiment of the apparatus, the substrate has a composition including one or more members of the following polymers or mixtures of polymers: polycarbonates (PC), polyvinylchloride (PVC), polyethylene terephthalate (PET), modified polyethylene (PE), polypropylene (PP), polyamides (PA) and polytetrafluoroethylene (PTFE) (which are all commercially available). In further embodiments of the apparatus, the one or more binders have a composition including one or more members of the following polymers or mixtures of polymers: polystyrene (PS), polymethylmethacrylate (PN/WIA), polyvinyl alcohol (PVA), polyacrylics (PA), polyurethanes (PU), epoxy polymers or resins (ER) and/or 3D polymers (e.g., "VisiJet" and others). In various embodiments of the apparatus, the one or more pigments are insoluble in water and alcohols. In other embodiments, the pigments and dyes are soluble and/or dispersible. In addition, the alcohols are selected from the group of C1-C3 alcohols. In an additional embodiment of the apparatus, the one or more pigments have a composition selected from the group that includes, but is not limited to, ZnO, phthalocyanine, CdS, $TiO_2$, carbon black, Fe oxides, lithol, dinitroaniline, pyrazolol, and quinacridone.

The apparatus further includes means for "fusing" the one or more binders and means for initiating a reaction of the monomers to form a polymer mass and one or more pigments to the substrate with photonic or thermal energy or both at once to form an image or text. As used herein, the term "fusing" refers to heat-induced diffusion of pigments and/or dyes into substrates and substrate surfaces, thereby embedding them in the substrates; fusing may be achieved by heating the substrates polymers to a temperature near but below the glass transition ($T_g$) of (which may be as high as 140° C. for a PC) so as to create a thermoplastic surface soft state over. The term "substrate" refers to an article, card, surface, or document on which an image or text is received. Non-limiting embodiments of the substrates may include plastic forms, special books or booklets and papers. The work substrates can include different materials and sizes. For example, without limitation, the substrate may include a shape or form of a plastic card commonly used for identification purposes, credit cards and the like, and paper and pages used in secure documents such as passports and other similar documentation. These substrates may be specialized in the sense that the substrate bears or has one or more security features. For example, the substrate may incorporate materials (e.g., inks, pigments and/or dyes) that have features which produce optical effects or images or combination of both. Embodiments of the present disclosure allow these selected individual features to be marks of authenticity without compromising the high resolution, color image printing/engraving quality of final security documents. For example, without limitation, one embodiment of the present invention features a substrate having a layer of an additive which additive makes the substrate more reactive or absorptive of thermal energy.

As used herein, the term "reactive polymers" refers to compounds capable of additional polymerization by crosslinking. The compounds capable of polymerization may be comprised of repeating units which are capable or further reactions with an initiator because of the availability of double bonds, oxygen, nitrogen and other kinds of elements or chain bridges. Reactive polymers include, by way of example, without limitation, epoxy resins (ER), polyurethanes (PU), polyacrylics (PA), polymethylmethacrylates (PMMA), polystyrene (PS), and polyvinyl alcohol (PA). These reactive monomers are present with the binder in wide weight percent range of 1 to 18% and in many cases up to 90% of a crosslinkable or a curable ink vehicle component of the ink composition that contains also pigments, dyes and additives in it (additives typically include different radiation initiators and also antifoams, fillers, adhesion promotors etc.). The reactive polymers may comprise monomers which participate in the polymerization reactions.

As used herein, the term "initiator" refers to compounds that form a free radical or/and ion in the presence of photons. The free radical or ions are capable of initiating crosslinking polymerizations of the reactive polymers. By way of example, without limitation, initiator compounds include 2-hydroxy-2-methyl propiophenone, 2-hydroxy-4'(2-hydroxy ethoxy)-2-methyl propiophenone, 1-hydroxy cyclo hexophenyl ketone, methylbenzoyl formiate, diphenyl tri methylbenzoyl)-phosphine oxide, phosphine oxide, phenyl bis (2,4,6-trimethyl benzoyl), 2-methyl-1 (methyl thio) phenyl]-2-(4-morpholinyl)-1-propanone, 2-benzyl-2-(dimethyl amino)-1 (4-morpholinyl) phenyl]-butanone, 2-dimethyl amino-2-(4-methyl-benzyl)-1-(4-morpholin-4-yl-phenyl)-butane-I-one, bis (.eta.5-2,4-cyclopentadiene-1-yl)-bis(2,6-difluoro-3-(IH-pyrrole-1-yl)-phenyl)titanium, 2-isopropyl thioxanthone, 2-ethyl anthraquinone, 2,4-diethyl thioxanthone, benzyl dimethyl ketal, benzophenone, 4-chloro benzophenone, methyl-2-benzoyl benzoate, 4-phenyl benzophenone, 2,2'-bis (2-chlorophenyl)-4,4',5,5'-tetraphenyl-1,2'-bi-imidazole, 2,2',4tris(2-chlorophenyl)-5-(3,4-dimethoxyphenyl)-4'5'-diphenyl-1,1'-diimidazole, 4-phenoxy-2 2'-dichloro acetophenone, ethyl-4-(dimethyl amino)benzoate, isoamyl 4-(dimethyl aminobenzoate, 2-ethyl hexyl-4-(dimethyl amino) benzoate, 4,4'bis(diethyl-amino) benzophenone (Michler's ethyl ketone), 4-(4'-methylphenyl thio)-benzophenone, 1,7-bis(920 acridinyl)heptane and N-phenyl glycine, 4-benzoyl-4' methyl diphenyl sulfide, bis(dodecyl phenyl)-iodonium-hexafluoro-antimonate, triaryl sulfonium hexafluoro antimonite salts, bis(4-tert-butylbhenyl)iodonium perfluoro-butane sulfonate, poly(N-vinyl carbazole). These and others are available from numerous vendors including, by way of example, without limitation, CIBA, Synlab GmbH (Germany), Sigma Aldrich, and Rahn. Several initiator products are sold under trademarks such as, by way of example, without limitation, INGCURE and DAROCURE (Ciba) and DEUTERON (Synlab).

Sigma Aldrich publishes a Photo Initiators Resource online, which is incorporated herein by reference. This resource identifies at least the following initiators: acetophenone, anthraquinone, anthraquinone-2-sulfonic acid, sodium salt monohydrate, (benzene)tricarbonyl chromium, benzyl, benzoin, benzoin ethyl ether, benzoin isobutyl ether, benzoin methyl ether, benzophenone, benzophenone/1-hydroxy cyclohexyl phenyl ketone, 3,3',4,4'-benzophenonetetracarboxylic dianhydride, 4-benzoylbiphenyl, 2-benzyl-2-(dimethyl amino)-4'-morpholinobutyrophenone, 4,4'-bis (diethylamino)benzophenone, 4,4'-bis(dimethyl amino) benzophenone, camphor quinone, 2-chlorothioxanthen-9-one, (cymene)cyclopentadienyl iron(ll) hexafluorophosphate, dibenzosupereon, 2,2-diethoxy acetophenone, 4,4'-dihydroxybenzophenone, 2,2-dimethoxy-2-phenylacetophenone, 4-(dimethyl amino)benzophenone, 4,4'-dimethylbenzil, 2,5-dimethylbenzophenone, 3,4-dimethylbenzophenone, diphenyl(2,4,6-trimethylbenzoyl)phosphine oxide/2-hydroxy-2-methylpropiophenone, 4'-ethoxy-acetophenone, 2-ethylanthraquinone, ferrocene, 3'-hydroxyacetophenone, 4'-hydroxyacetophenone, 3-hydroxybenzophenone, 410-hydroxy benzophenone, 1-hydroxycyclohexylphenyl ketone, 2-hydroxy-2-methylpropiophenone, 2-methylbenzophenone, 3-methylbenzophenone, methyl benzoyl formiate, 2-methyl-4'-(methyl thio)-2-morpholinopropiophenone, phenanthrenequinone, 4'-phenoxy-acetophenone, thioxanthen-9-one, triaryl sulfonium hexafluoro antimonate salts, mixed 50% in propylene carbonate, and triaryl sulfonium hexafluorophosphate salts, mixed 50% in propylene carbonate.

The photoinitiator is an additive typically used in concentrations of 0.5-6% by weight. For example, without limitation, initiator compounds are present in a concentration ranging from 0.005 to 10% by weight depending on the type of application.

One embodiment of the present invention features an apparatus further comprising means for applying at least one activation agent on the substrate. The activation agent makes the substrate more reactive at least to one of the means for fusing and means for photoactivation for crosslinking or curing. The activation agent is selected from the one or more of the group of dyes and colorants which absorb a wavelength of light that is emitted by one or more lasers.

For example, without limitation, the activation agent comprises one or more compounds of the group comprising oligomeric and polymeric electron-transfer photosensitizers which participate in onium salt photoinitiated cationic polymerizations of epoxides and vinyl ethers. Poly (N-vinyl carbazole) (PVK) is an efficient photosensitizer. PVK functions as an electron-transfer photosensitizer for a wide variety of onium salt cationic photoinitiators, including diaryliodonium, triaryl sulfonium, and dialkylphenacyl sulfonium salts. The broadening of the spectral response through the use of these photosensitizers accounts for the observed rate enhancement of these polymerization reactions. Alternating copolymers prepared by the free radical polymerization of vinyl carbazole (NVK) with vinyl monomers also exhibit excellent photosensitization activity. Photosensitizers also comprise use of a dimeric photosensitizer prepared by the hydrolyzation of N-vinyl carbazole with 1,1,3,3-tetramethyldisiloxane.

The activation agent is present in an amount ranging from 0.05 to 25% by weight, or, more commonly the concentration is around 2%. The activator is applied to the substrate prior to further processing. In a further embodiment, the activator is placed in the substrate as a layer or integral composition within the substrate. For example, fluorescence and singlet molecular oxygen ($^1O2$) quantum yields for phloxine B loaded poly(2-hydroxyethyl methacrylate) thin films are determined at dye concentrations from 0.015 to 22 wt %. Fluorescence self-quenching and the fall off of the $^1O2$ quantum yield observed above 0.1 wt % are attributed to very weakly interacting close-lying dye molecules acting as energy traps arising from molecular confinement. The maximum singlet oxygen generation efficiency (quantum yield×absorption factor) lies at concentrations around 2 wt % where fluorescence self-quenching amounts to more than 80%.

One embodiment of the apparatus further includes a computer element that sends commands to a laser or an array of lasers integrating with a laser scanner or an optical system having mirrors and/or lenses for making ID documents. The computer element is in communication with the means for "fusing" to produce an image or text by tuning and alternating parameters of the laser/laser array. That is, the computer element translates or processes images or text into pixels and directs the means for fusing to fuse pigments (and/or dyes) and binder in a plurality of locations which conform with the image or text. Thus, the image or text is a plurality of pixels on the computer screen and each pixel of the image or text is printed as a dot occupying a location on the substrate. For example, without limitation, embodiments of pixels/dots may include sizes selected from the range of 1-10 μm to 80 μm-120 μm, alternatively, pixel/dot embodiments may exhibit a 25-spacing selected from the range of 1-4 μm to 40 μm-120 μm. In further embodiments, the pixel/dot size is selected from the range of 20 μm-40 μm to 40 μm-60 μm and the pixel/dot spacing is selected within the range from 5-20 μm to 20 μm-40 μm. In other embodiments, additional features may be represented on the substrate in non-pixel or vector formats.

Each pixel/dot includes at least one pigment, dye and binder, unless the pixel/dot is formed by carbonization of the surface of the substrate. One embodiment features a plurality of pigments and/or dyes to form a range of colors. The process is additive to the substrate, with the exceptions of the formation of pixels/dots by carbonization of the substrate surface. In certain embodiments, the pixels/dots present a raised texture above the surface of the substrate or an ablated texture below the surface of the substrate, which in itself provides a means for identifying the authenticity of documents prepared by the present process.

One embodiment features means for applying a pigment, a reactive polymer, initiator and binder that applies a pigment for a first color. The means for applying dry formulations may include, by way of example, without limitation, one or more of dusting of the pigment, reactive polymer, initiator and binder to the substrate, electrostatic deposition of the pigment and binder to the substrate, and pressure-assisted deposition techniques such as spray coating and, in some embodiments, pre-deposition of pigments and/or dyes on a transparent intermediate PET foil media—ribbon roll.

Another embodiment features means for removal of unfused pigment and or preliminary mixed with a binder, reactive polymer (oligomer) and initiator after fusing and reacting. The means for removal may include, by way of example, without limitation, one or more of brushing, vacuum removal, sweeping, and the like. The removed pigment, crosslinkable reactive polymer, initiator and/or a composition of all that is the binder for pigments is thus available to be reapplied to the substrate or a different substrate.

One embodiment features means for applying a pigment and binder which applies the first portion of the pigment, reactive polymer, initiator and binder that is fused to the substrate and the unfused remainder is removed from the substrate and subsequently applies a second pigment and binder. The second pigment is for a second color. Although referred herein as a second pigment, the reference applies to all subsequent pigments. It is common to work with four pigments, cyan (C), yellow (Y), magenta (M), and black (K), to form a substantially full range of colors perceptible to the human eye..

One embodiment of the present apparatus includes means for making one or more pixels/dots which includes a carbonized area of the substrate in lieu of, or in combination with, a black pigment. The means to produce such a carbonized area may include lasers. Such lasers may be adjusted to (i) output light suitable for fusing pigments and binders as well as carbonization of the surface of the substrate, (ii) apply the K (black) color to reduce color scales of the Y, C and M colors and (iii) simultaneously have the black color marked with a combination of other colors for providing an additional security feature. Also, besides the black (K) color, other direct laser colors (such as red, brown, yellow, or green) may be directly created on the substrate surface by changing the surface chemistry without using any formulations of binders, pigments, dyes and additives.

One embodiment of the present apparatus features a first pigment for a first color and a second pigment for a second color and means for applying the first pigment and the second pigment concurrently. The fusing means and the reacting means are capable of fusing the first pigment or diffusing a dye under a first set of fusing and reacting conditions and a second pigment under a second, different set of fusing and reacting conditions to create pixels/dots of different colors that form full-color images. For example, without limitation, where the fusing means and reacting means is one or more lasers, a first laser applies one wavelength of light to fuse and react monomers and binder associated with a first pigment and a second laser applies a second wavelength of light to fuse and react binders and monomers associated with a second pigment. Or, in alternative embodiments, one laser may apply a first wavelength of light for a pixel/dot of a first pigment and be adjustable to apply a second, different wavelength of light that is applied to a second pixel/dot for a second pigment.

One embodiment features an apparatus for making a substrate having laser etched marks or hollows. The formulation is placed in one or more laser etched marks on the surface of the substrate and at least a portion is fused thereto. One embodiment features a laser for making such laser etched marks or hollows in the surface of the substrate.

One embodiment features an apparatus for making a substrate having a full-color image utilizing a laser operated in the visible and/or UV spectrum with a low average power laser (e.g., less than 500 mW or, in some embodiments, less than 400 mW); this laser may be activated at, for example, a Q-switched pulsed mode for less than 30 nanoseconds with a pulse repetition range of 5-100 kHz in order to transfer dye colors from a pre-deposited ribbon having three colors (Y, M, and C) to a polycarbonate (PC) substrate and can mark the K color on the PC substrate. Alternatively, the laser may transfer four colors (e.g., YMCK) from a ribbon. The PC substrate may then be heated to the glass transition temperature (approximately 140° C. for PC) in an additional fixation station so as to cause fusing and/or dye diffusion into the bulk of the substrate. This way, the full-color ID document image does not need additional protections (such as by overlay, lamination or any procedure that is otherwise necessary in conventional transfer-printing processes).

One embodiment features means for dispersing or dissolving color pigments and/or dyes in a UV reactive polymer. The UV polymer, similar to or having the same composition as a 3D printing polymer, is used as a binder that applies a pigment or a dye on the substrate to produce the first and subsequent colors thereon. For example, the first and subsequent colors may be produced by pre-depositing UV curable film directly on the polymer substrate (which may be the ID document) or on a ribbon intermediate media that can be directly cured using the UV laser or simultaneously transferred and cured on the substrate surface. The formulations suitable for being applied onto the ID document substrate and used in conjunction with the UV laser may include, by way of example, without limitation, one or more pigments, UV curable polymers, initiators and plasticizers. These formulations may provide benefits including that they are UV cureable and can be strongly attached to the substrate surface for producing color dot pixels for the images and text, and also that they create relief of the images and text on the substrates. Thus, the tactile (engraving) surface relief caused by the laser is an additional ID document protection feature generated by the ID hardware personalization process.

The formulations of the present disclosure may further include compounds or special application methods to effect further security features. For example, without limitation, the apparatus can fuse the pigments and/or dyes such that one or more selected pigments appear when viewed at certain angles and not at other angles. In further embodiments, the formulations may include one or more luminescent compounds (e.g., fluorescent and/or phosphorescent compounds) which can be identified under certain defined illumination or viewing conditions.

A further embodiment of the disclosure is directed to a method of placing an image or text on a substrate. The method includes the step of applying a formulation including one or more binders, one or more reactive polymers, one or more initiators and one or more pigments to a substrate. The substrate has a composition selected from the group of polymers or mixtures of polymers. The binders have a composition selected from one or more polymers or mixtures of polymers transparent to visible light and different from the substrate. The one or more reactive polymers comprise at least one polymer and/or monomer capable of forming a polymeric mass in the presence of reaction conditions and photoactivation of the initiator. The initiator forms a free radical or ion in the presence of photons and the free radical or ion is capable of initiating polymerization of the reactive polymers. The one or more pigments have a composition selected from the group consisting of inorganic and insoluble hybrid inorganic-organic color products. The method further includes the step of fusing the one or more binders and one or more pigments to the substrate with photonic or thermal energy or both at once and initiating a reaction of the polymers to form a polymeric mass to form an image or text.

In an embodiment of the method, the substrate has a composition selected from the group of polymers or mixtures of polymers consisting of polycarbonates (PC), polyvinylchloride (PVC), polyethylene terephthalate (PET), modified polyethylene (PE), polypropylene (PP), polyamides (PA) and polytetrafluoroethylene (PTFE). In further embodiments of the method, the one or more binders have a composition selected from one or more polymers or mixtures of polymers consisting of polystyrene (PS), polymethylmethacrylate (PN/WIA), polyvinyl alcohol (PVA), polyacrylics (PA), and polyurethanes (PU). In further embodiments of the method, the one or more pigments are insoluble in water and alcohols. In other embodiments, the alcohols are selected from the group of C1-C3 alcohols. In an additional embodiment of the method, the one or more pigments have a composition selected from the group that includes, but is not limited to, ZnO, phthalocyanine, CdS, $TiO_2$, carbon black, Fe oxides, lithol, dinitroaniline, pyrazolol, and quinacridone.

One embodiment of the method features the step of forming an image or text including one or more pixels/dots. The method includes controlling the means for fusing to fuse said one or more pigments in said one or more pixels/dots on the substrate to produce the image or text. One embodiment features means for fusing and curing and means for activating the initiators under the control of a computer element that sends commands to the laser head of the apparatus for color imaging, image and text marking and tactile engraving when needed. The computer element processes the images and text to be placed on the substrate, where the images and text include one or more pixels/dots. The pixels/dots include one or more areas of substrate having a pigment set in a binder fused to a surface of the substrate.

The application of one or more pigments, reactive polymers, initiators and binder is an additive process, except where one or more of the pixels/dots are formed by a carbonization or direct colors using a laser induced chemical reaction on the substrate surface. Pigments, reactive polymers, initiators and binders which are not reacted and fused to the substrate in the reaction and fusion step, sometimes referred to herein as unfused pigment and binders, can be removed from the substrate and recycled. For example, embodiments of the method of the present disclosure include the step of applying a first pigment for a first color, where a first portion of the pigment and binder undergoes a fusion step to form fused pigment (and/or dye) and binder and a reaction step to react reactive polymer to form a polymerization product and a second portion of the pigment (and/or dye), reactive polymer, initiator and binder are unfused. The unfused binder, reactive polymer, initiator and pigment (and/or dye) is removed from the substrate. A further embodiment of the method includes the step of applying a second pigment (and/or dye) and binder. The second pigment is for a second color, different than the first color. The second pigment and binder is subjected to a further fusion step to form fused second pigment (and/or dye) and binder and a further reaction step to react reactive polymer to form a polymerization mass and unfused and unreacted second pigment and binder and monomer.

A further embodiment of the method includes a step where one or more pixels/dots are applied to carbonize the surface of the substrate.

One embodiment of the present method includes the application of a first pigment (and/or dye) and second, different pigment (and/or dye) concurrently for a first color and a second color, respectively. The method includes the step of the fusing means and reacting means reacting and fusing a first pigment (and/or dye) under a first set of fusing conditions and reacting reactive polymers and initiators associated with the first pigment (and/or dye) under a first reaction conditions and a second pigment (and/or dye) under a second, different set of fusing and reacting conditions. For example, without limitation, when the fusing means is one or more lasers, the one or more lasers applies a first wavelength of energy to fuse a first pigment (and/or dye) and react a monomer and initiator and a second wavelength to fuse a second pigment (and/or dye) and react a monomer and initiator associated with the second pigment (and/or dye).

Or, in alternative embodiments, one laser may apply a first wavelength of light for a pixel/dot of a first pigment and be adjustable to apply a second, different wavelength of light that is applied to a second pixel/dot for a second pigment.

One embodiment of the present method features a substrate having one or more laser-etched marks to receive a pigment, reactive polymer, initiator and binder. The laser-etched marks may be pre-formed in the substrate or made by lasers. The one or more pigments, reactive polymers, initiators and binders are reacted and fused in the laser-etched marks to form one or more pixels/dots.

The formulations of embodiments of the present method further include additional ingredients and compositions to place personalized features on the substrate. For example, without limitation, one method features a formulation including a luminescent compound (e.g., a fluorescent and/or phosphorescent compound), which can be used with a pigment or without a pigment. One or more pixels/dots include a luminescent compound to impart a security identification feature. In further embodiments of the method, the pigments may be fused to the substrate such that one or more selected pigments appear when viewed at certain angles and not at other angles.

A further aspect of embodiments of the present disclosure is directed to a formulation for placing an image or text on a substrate. The formulation includes one or more binders, one or more reactive polymers, one or more initiators and one or more pigments. The one or more binders have a composition selected from one or more polymers or mixtures of polymers transparent to visible light. The one or more pigments have a composition selected from the group consisting of inorganic and insoluble hybrid inorganic-organic color products.

In an embodiment of the formulation, the one or more binders have a composition selected from one or more polymers or mixtures of polymers consisting of polystyrene (PS), polymethylmethacrylate (PNWIA), polyvinyl alcohol (PVA), polyacrylics (PA), polyurethanes (PU). In further embodiments of the formulation, the one or more pigments are insoluble in water and alcohols. In other embodiments, the alcohols are selected from the group of C1-C3 alcohols. In an additional embodiment of the formulation, the one or more pigments have a composition selected from the group consisting of ZnO, phthalocyanine, CdS, $TiO_2$, carbon black, Fe oxides, lithol, dinitroaniline, pyrazolol, quinacridone. One formulation has a binder present in a range of 0.1 wt % to 5 wt %. One formulation of has pigment present in a range of 1 wt % to 40 wt %.

A further aspect of embodiments of the present disclosure is a substrate for receiving an image or text. The substrate is constructed and arranged to cooperate with an apparatus for placing the text or image on the surface using a laser. For example, one substrate has a composition selected from the group of polymers or mixtures of polymers transparent to visible light. In certain embodiments, the substrate has a composition selected from the group of polymers or mixtures of polymers consisting of polycarbonates (PC), polyvinylchloride (PVC), polyethylene terephthalate (PET), modified polyethylene (PE), polypropylene (PP), polyamides (PA) and polytetrafluorethylene (PTFE). The substrate has surface characteristics including at least one of a glass transition temperature between 75° C. and 150° C. and a melting point between 100° C. and 270° C., depending upon the molecular weight, the upper surface layer, and the blend ratio of the substrate composition. One embodiment of the substrate has pre-formed indentations for receiving pigment and binder formulations. In further embodiments, one such substrate has pre-formed indentations in pixel/dot locations.

One embodiment of the present invention features a substrate further comprising at least on activation agent. The activation agent makes the substrate more reactive at least to one of the means for fusing and curing and means for photoactivation. The activation agent is selected from the one or more of the group of dyes and colorants which absorb a wavelength of light that is emitted by one or more lasers. For example, without limitation, the activation agent comprises one or more compounds of the group of 3-ketocoumarins with alkoxy or dialkylamino substituents in the $7^{th}$ position, which are efficient sensitizers for crosslinkable polymers, were evaluated as photo initiators. Proper combinations of certain derivatives of these keto coumarins with activators such as amines, acetic acid derivatives, and alkoxy pyridinium salts gave quantum yields for initiated radical polymerization much higher than that obtained from the Michler's ketone/benzophenone combinations. For each class of activators, the dependence of the efficiency of polymerization on the redox properties of the keto coumarins can be explained in terms of charge transfer or electron transfer from the activator to the excited keto coumarin (acetic acid and amine activators, respectively) or electrons transfer in the opposite direction (pyridinium salt activators). The activation agent is present in an amount ranging from 0.05 to 20%. The activator is applied to the substrate prior to further processing. In a further embodiment, the activator is placed in the substrate as a layer or integral composition within the substrate.

A further aspect of embodiments of the present disclosure is directed to a substrate bearing an image or text. The substrate has a composition selected from the group of polymers or mixtures of polymers transparent to visible light. In certain embodiments, the substrate has a composition selected from the group of polymers or mixtures of polymers consisting of polycarbonates (PC), polyvinylchloride (PVC), and polyethylene terephthalate (PET), modified polyethylene (PE), polypropylene (PP), polyamides (PA) and polytetrafluoroethylene (PTFE). The substrate surface bears one or more pigments having a composition selected from the group consisting of inorganic and insoluble hybrid inorganic organic color products. In further embodiments, the one or more pigments are insoluble in water and alcohols. In other embodiments, the alcohols are selected from the group of C1-C3 alcohols that disperse and/or dissolve dyes. In certain embodiments, the substrate surface bears one or more pigments including, but not limited to, ZnO, phthalocyanine, CdS, $TiO_2$, carbon black, Fe oxides, lithol, dinitroaniline, pyrazolol, quinacridone and similar. The one or more pigments and/or dyes are fused to the substrate with one or more binders and/or held in a polymeric mass formed by the reaction of reactive polymers and initiators. The one or more binders have a composition selected from one or more polymers or mixtures of polymers transparent to visible light and different from the substrate. In certain embodiments, the one or more binders is selected from the group consisting of polystyrene (PS), polymethylmethacrylate (PMMA), polyvinyl alcohol (PVA), polyacrylics (PA), and polyurethanes (PU).

The image or text includes one or more pixels/dots formed of the fused pigments and binders. The binders and pigments form a mass having a depth extending up to 0.9 mm from the surface mean and/or an elevation extending up to 0.6 mm above the surface mean. The pixels/dots may also include a carbonized area of the substrate.

One embodiment of the present disclosure is a substrate constructed and arranged in the form of a personalized document. One such personalized document has a luminescent compound (e.g., a fluorescent or luminescent compound) in one or more pixels/dots.

In another aspect, the invention relates to a method of manufacturing a personalized identification document. In various embodiments, the method includes the steps of providing a polymeric substrate for the identification document; providing multiple panels or containers, each having a dye or a pigment; activating a single laser to transfer, to the substrate, the first dye or pigment from the first panel or container and the second dye or pigment from the second panel or container, the second panel or container having the second color different from the first color in the first panel or container; and causing the first and second dyes or pigments to diffuse in the substrate. The single laser may be a green laser operating at substantially 532 nm or an ultraviolet laser operating at substantially 355 nm. In addition, the panels or containers may have a yellow-color dye or pigment, a magenta-color dye or pigment, and a cyan-color dye or pigment only.

In some embodiments, the method further includes, prior to transferring the dyes or pigments to the substrate, generating a non-removable layer having a black color thereon without utilizing an ink. In one implementation, the non-removable layer is generated by carbonizing the substrate; and the carbonization is created using a non-infrared laser. In addition, the step of causing the first and second dyes or pigments to diffuse into the substrate may include heating the polymeric substrate via, e.g., thermal convection, conduction or radiation. The method may further include, prior to activating the single laser, determining and adjusting one or more parameters (e.g., a power, a frequency, a pulse number, a pulse duration, a spot size, an image resolution, and/or a step size) associated with the single laser based at least in part on absorbing wavelengths of the first and second dyes or pigments. In one implementation, the polymeric substrate consists essentially of polycarbonate.

Another aspect of the invention relates to a method of manufacturing a personalized identification document. In various embodiments, the method includes the steps of providing a polymeric substrate for the identification document; providing multiple panels or containers, each having a dye or a pigment; heating the polymeric substrate to a temperature higher than a room temperature but below a glass-transition temperature of the polymeric substrate; transferring, to the polymeric substrate, the first dye or pigment from the first panel or container and the second dye from the second panel or container, the second panel or container having the second color different from the first color in the first panel or container; and causing the first and second dyes or pigments to diffuse in the substrate.

In yet another aspect, the invention pertains to a method of manufacturing a personalized identification document. In various embodiments, the method includes the steps of providing a polymeric substrate for the identification document; providing multiple panels or containers, each having a non-black dye or a pigment; generating a non-removable layer having a black color on the substrate without utilizing an ink; transferring, to the polymeric substrate, the first dye or pigment from the first panel or container and the second dye or pigment from the second panel or container, the second panel or container having the second color different from the first color in the first panel or container; and causing the first and second dyes or pigments to diffuse in the substrate.

Still another aspect of the invention relates to an apparatus for manufacturing a personalized identification document. In various embodiments, the apparatus includes means for supporting a polymeric substrate for the identification document; means for supporting multiple panels or containers, each having dye or a pigment; a single laser for transferring, to the substrate, the first dye or pigment from the first panel or container and the second dye or pigment from the second panel or container, the second panel or container having the second color different from the first color in the first panel or container; and means for causing the first and second dyes or pigments to diffuse in the substrate.

In another aspect, the invention relates to an apparatus for manufacturing a personalized identification document. In various embodiments, the apparatus includes means for supporting a polymeric substrate for the identification document; means for supporting multiple panels or containers, each having a dye or a pigment; means for heating the polymeric substrate to a temperature higher than a room temperature but below a glass-transition temperature of the polymeric substrate; means for transferring, to the polymeric substrate, the first dye or pigment from the first panel or container and the second dye or pigment from the second panel or container, the second panel or container having the second color different from the first color in the first panel or container; and means for causing the first and second dyes or pigments to diffuse in the substrate.

In still another aspect, the invention relates to an apparatus for manufacturing a personalized identification document. In various embodiments, the apparatus includes means for supporting a polymeric substrate for the identification document; means for supporting multiple panels or containers, each having a non-black dye or pigment; means for generating a non-removable layer having a black color on the substrate without utilizing an ink; means for transferring, to the polymeric substrate, the first dye or pigment from the first panel or container and the second dye or pigment from the second panel or container, the second panel or container having the second color different from the first color in the first panel or container; and means for causing the first and second dyes or pigments to diffuse in the substrate.

These and other features and advantages of embodiments of the present disclosure will be apparent to those skilled in the art upon viewing the drawings which are described briefly following section and studying the detailed description below.

BRIEF DESCRIPTION OF THE DRAWINGS

FIG. 5 is a schematic illustration of an embodiment of a third method of the present disclosure.

DETAILED DESCRIPTION OF THE INVENTION

Embodiments of the present invention will now be described in detail with respect to preferred embodiments and best mode with regard to a security document in the form of a card. However, this description is not intended to be limiting and those skilled in the art will recognize the utility of the present invention to make and present images and text in a variety of mediums and for a variety of purposes. For example, without limitation, embodiments of the present invention have utility to make special labels or for presenting text and images of any article.

Figure 1:
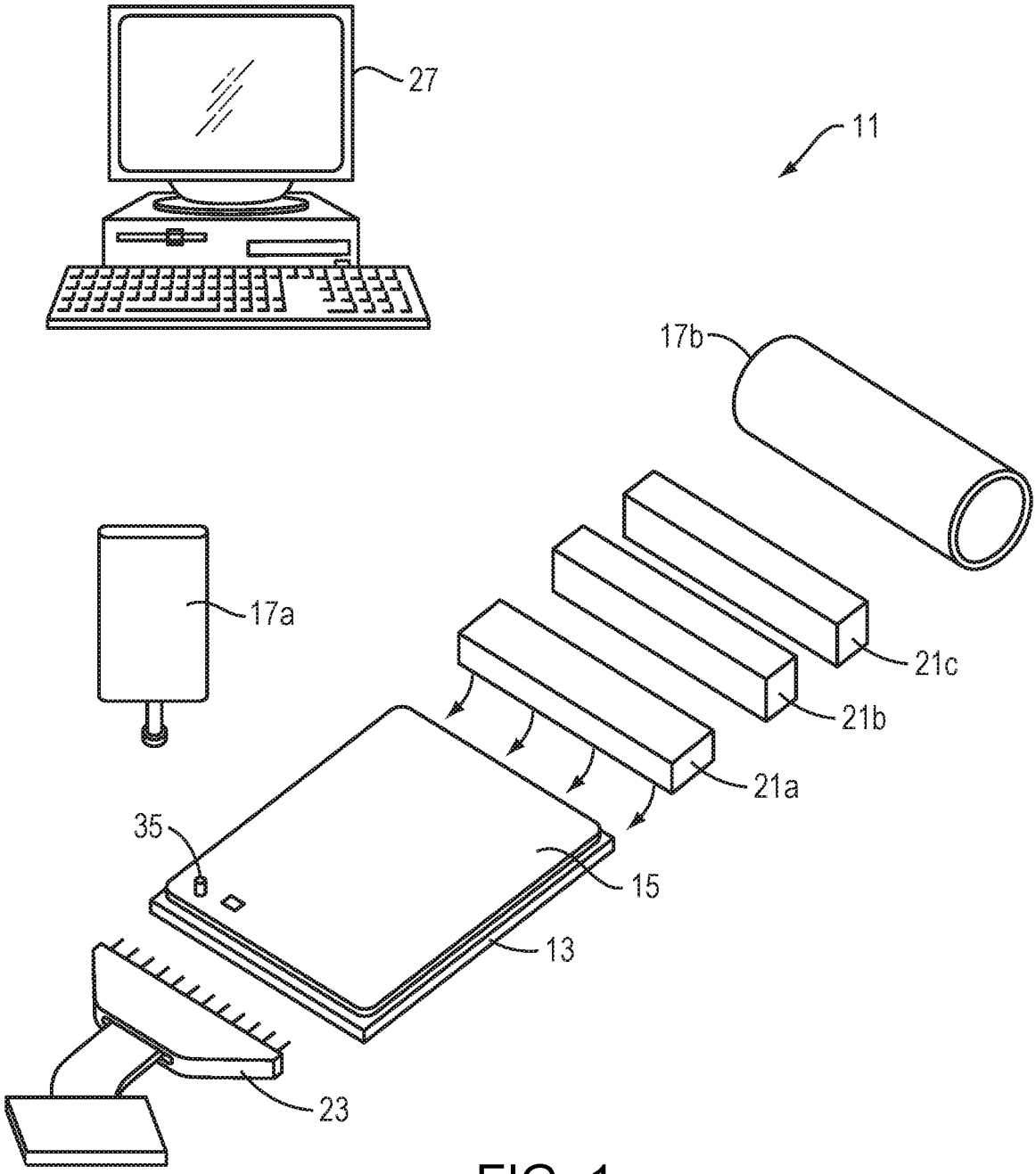
FIG. 1 is an apparatus for printing secure documents in the nature of driver's licenses, passports and other identification documents.

Turning now to FIG. 1, an apparatus for making secure documents in the nature of driver's licenses, passports and other identification documents, generally designated by numeral 11, is depicted. In various embodiments, the apparatus 11 includes a substrate holder 13 holding a substrate 15; a means 17*a* (e.g., an optical system) for fusing and initiating a reaction (such as a laser imaging, laser marking or dye-transferring through a ribbon), initiating a reaction of the initiator and monomer to form a polymerization mass when primary colors are pigments and applying formulation, of which three are depicted 21*a*, 21*b* and 21*c*. In addition, the apparatus 11 may include a thermal device 17*b* for heating the substrate 15; this is particularly useful for enabling sublimated dyes (if dye ribbons instead of pigments are used for creating colors on the substrate) to diffuse in the substrate 15. In some embodiments, the apparatus 11 further includes a removal element 23 when necessary; and a computer element 27.

Apparatus 11 is used to place text or images on substrate 15. Substrate 15 is constructed and arranged in the shape and form of a photo identification card or a passport data page. However, substrate 15 may comprise any article for which an image or text may be placed. Photo identification cards typically have special manufacturing steps which encode visual cues to enable individuals reviewing so as to ascertain whether the document is authentic. For example, without limitation, the cards may provide a special background or foreground. The background or foreground may appear at certain angles of viewing. These special optical and/or physical features are combined with electronic features and biographical/biometric information. The substrate has a composition selected from the group of polymers or mixtures of polymers. In certain embodiments, the substrate has a composition selected from the group of polymers or mixtures of polymers consisting of polycarbonates (PC), polyvinylchloride (PVC), polyethyleneterephalate (PET) modified polyethylene (PE), polypropylene (PP), polyamides (PA) and polytetrafluoroethylene (PTFE). In further embodiments, the substrate may be a commercially available, multi-layered product such as DURA 10 and DURA $7^{1M}$ (ABNote USA, Inc., Boston, Mass.) multilayered pc and PC/PVC blends, HID$^{IM}$, 3M$^{IM}$ Polycarbonate Security Film, or similar.

The apparatus 11 has means for applying one or more formulations 21*a*, 21*b*, and 21*c*. The means for applying the formulation(s) 21*a*, 21*b*, and 21*c* is constructed and arranged in accordance with the nature of the formulation(s). The formulation(s) may be in the nature of a powder, aerosol, foam, liquid, solution, slurry, suspension and/or pre-deposition on a ribbon. The means comprise conduits (not shown) or, as depicted, containers which have openings (not shown) which deposit, spray, pour or otherwise place the formulation(s) (e.g., transfer from a ribbon (not shown)) represented by arrows, onto the substrate 15. The containers 21*a*, 21*b*, and 21*c* are drawn over the substrate 15 and/or the substrate 15 moved under the containers 21*a*, 21*b*, and 21*c* on moving tracks or runners (not shown) to deposit the formulation(s) on the surface of the substrate 15.

In further embodiments, the apparatus 11 may additionally include means for attracting the formulation in contact with the substrate 15 prior to reacting and fusing. In an embodiment, the formulation may be urged onto substrate 15 through the use of electrostatic forces by a corona discharge. The substrate 15 may optionally have indentations premade or made through laser treatment with the laser 17*a* to retain formulation(s).

In further embodiments, should these electrostatic forces alone be insufficient to maintain the formulation in contact with the substrate, other physical mechanisms (e.g., by shaking mesh spreading) may be employed, alone or in combination with electrostatic forces. In one embodiment, a transparent glass sheet (not shown) is placed upon the surface of the substrate 15 before a color ribbon is used for laser transfer or after the formulation(s) is deposited and prior to fusing of the pigment (and/or dye) into the substrate 15.

The formulation comprises one or more binders, one or more monomers, one or more initiators and one or more pigments. In certain embodiments, the binders, reactive polymers and initiators are dissolved in a solvent and deposited as a film on the surface of the pigment particles on an intermediate media (e.g., a ribbon). The size of the pigment particles may be selected from the range of 0.1 μm-500 μm and the size of the dyes is approximately 5-100 nanometers or can be any suitable molecular size for the dye to sublimate before diffusing into the substrate 15. For example, the pigment size lower bound may be selected from the range of 1 μm-45 μm (e.g., 1 μm, 5 μm, 10 μm, 20 μm, 30 μm, 45 μm) and the pigment size upper bound may be selected within the range from 15 μm-500 μm (e.g., 15 μm, 25 μm, 35 μm, 40 μm, 50 μm, 60 μm, 100 μm, 125 μm, 180 μm, 200 μm, 300 μm, 400 μm, 500 μm). In liquid and liquid aerosol formulations, the pigment particle size may be selected from the range of 5 nm to 20 nm and, in some embodiments, in the molecular range (e.g., angstrom) for sublimating and diffusing dyes.

The binders have a composition selected from one or more polymers or mixtures of polymers transparent to visible light and different from the substrate. In an embodiment, the binders have a composition selected from one or more polymers or mixtures of polymers consisting of polystyrene (PS), polymethylmethacrylate (PMMA), polyvinyl alcohol (PVA), polyacrylics (PA), and polyurethanes (PU). Such binders may possess a single or double molecular weight distribution.

The initiators have a composition selected from 2-hydroxy-2-methyl propiophenone, 2-hydroxy-4'-(2-hydroxyethoxy)-2-methyl propiophenone, 1-hydroxycyclohexyphenyl ketone, methylbenzoyl formiate, diphenyl (2,4,6-trimethylbenzoyl)-phosphine oxide, phosphine oxide, phenyl bis (2,4,6-trimethyl benzoyl), 2-methyl-1-(methylthio)phenyl]2-(4-morpholinyl)-1-propanone, 2-benzyl-2-(dimethyl amino)-1-[4-(4-morpholinyl) phenyl]-1-butanone, 2-dimethylamino-2-(4-methyl-benzyl)-1-(4-morpholin-4-yl-phenyl)butane-1-one, bis(.eta.5-2,4-cyclopentadiene-1-yl)-bis(2,6-difluoro-3-(1-H-pyrrole-1-yl) phenyl)titanium, 2-isopropyl thioxanthone, 2-ethyl anthraquinone, 2,4-diethyl thioxanthone, benzyl dimethyl ketal, benzophenone, 4-chloro benzophenone, methyl-2-benzoylbenzoate, 4phenyl benzophenone, 2,2'-bis(2-chlorophenyl)-4,4',5,5'-tetraphenyl-1,2'-bi-imidazole, 2,2',4-tris(2-chlorophenyl)-5-(3,4-dimethoxyphenyl)-4',5'-diphenyl-1,1'-diimidazole, 4-phenoxy-2,2'-dichloro acetophenone, ethyl-4-(dimethyl amino) benzoate, isoamyl 4-(dimethyl amino) benzoate, 2-ethyl hexyl-4-(dimethyl amino) benzoate, 4,4'bis(diethylamino) benzophenone (Michler's ethyl ketone), 4-(4'-methylphenyl)-benzophenone, 1,7-bis(9-acridinyl)heptane and N-phenyl glycine. Also, for NIR photoinitiators selected to cause curing of the matrix at NIR wavelengths greater than 750 nm include cyanine dye-borate complexes. Commercially available IR photoinitiators include Dye 50455, CAS#5496-71-9, available from FeW Chemicals, Wolfen, Germany, and Dye NK-3897, available from Hyashibara, Okayama, Japan.

Embodiments of the one or more pigments have a composition selected from the group consisting of inorganic and insoluble hybrid inorganic-organic, heat resistive color products. In further embodiments, the one or more pigments are insoluble in water and alcohols. In other embodiments, the alcohols are selected from the group of C1-C3 alcohols and other solvents that dissolve dyes. Examples of such pigments may include, but are not limited to, ZnO, phthalocyanine, CdS, $TiO_2$, carbon black, Fe oxides, lithol, dinitroaniline, pyrazolol, quinacridone and similar. Further embodiments of the one or more pigments may include any pigments disclosed in the following, each of which is hereby incorporated by reference in its entirety.

Sales Range Brochure, "For the printing ink, paints, plastics industries and special applications"—Clariant (http://www.clariant.com/pigments). Specific embodiments may include, but are not limited to:

Pigment Yellow 16 GRAPHTOL Yellow GG
Pigment Yellow 74—HANSA Brilliant Yellow 5GX
Pigment Yellow 97—NOVOPERM Yellow FGL
Pigment Yellow 139 GRAPHTOL Yellow H2R
Pigment Yellow 180—PV Yellow HG
Pigment Orange 34—Permanent Orange RL 01
Pigment Red 146—Permanent Carmine FBB 02
Pigment Red 184—Permanent Rubine F6B
Pigment Blue 15:3—HOSTAPERM Blue B2G
Pigment Blue 15:3—PV Blue BG•Pigment Violet 23—HOSTAPERM Violet RL spec
Pigment Green 7—PV Fast Green GNX
MERCK Effect Pigments Information In further embodiments, the formulation comprises one or more additives. Examples of such additives include plasticizers, stabilizers, surfactants, suspending agents, foaming agents, and carrier liquids to promote accommodation of the one or more pigments within the formulation. Examples of plasticizers include butadiene-based plasticizers, dibutyl phthalate, glycols and similar. Examples of stabilizers include $CaCl_2$), $BaCl_2$, $CaCO_3$ and others. Examples of surfactants include dodecylbenzene sulfonic acids and salts. Examples of suspending agents include cellulose ethers, methylcellulose and similar. Examples of foaming and antifoaming agents include hydrocarbon emulsions, Zn stearate and similar. Examples of carrier liquids include distilled and deionized water and water/alcohol mixtures.

As depicted, the apparatus 11 has a means for applying one or more formulations 21*a*, 21*b* and 21*c* in the form of containers or from a ribbon. Each container 21*a*, 21*b* and 21*c* holds a formulation for a particular pigment. It is common to use pigments for cyan (C), magenta (M), yellow (Y). To form a substantially complete spectrum of colors visible to the human eye, a black color (K) is further utilized. Such black color may be provided in formulation maintained a fourth container (not shown) and/or achieved by carbonization of the substrate 15. However, in alternative embodiments, all pigments can be combined into a single container [not shown] and the laser 17*a* can be tuned to fuse different pigments, as will be described later.

The apparatus 11 has means for fusing the one or more pigments (and/or dyes) with binders and for initiating a reaction of the initiator and reactive polymers and one or more pigments to the substrate with photonic or thermal energy or both at once to form an image or text. The image or text is formed of a plurality of pixels/dots, where each pixel/dot has a defined color value (CMYK) and scale. The means for fusing and initiating a reaction comprises one or more lasers, represented by numeral 17*a* and/or one or more thermal devices represented by thermal device 17*b* (e.g., a fuser drum). In one embodiment, the laser 17*a* is used in a dye-application step rather than a fusing step as further discussed below. The laser 17*a* is also used to produce pixels/dots without formulations through carbonization of the substrate 15.

The laser 17 a produces light having a wavelength selected from the range of 200 nm to 2000 nm, e.g., 300 nm to 1200 nm. In further embodiments, the lasers may be compliant with laser safety class 1 through class 4. For example, embodiments of the laser 17*a* may include laser diode arrays operating at 830 nm, yttrium aluminum garnet (YAG) and vanadate lasers operating at 1064 nm, fiber lasers operating at 1070 nm, green lasers operating at 512 nm, and ultraviolet (UV) lasers operating at 355 nm, where the UV laser is employed for cold, non-thermal marking. Embodiments of the lasers may operate in pulsed Q-switch normally and occasionally continuous wave (CW) or quasi continuous.

In continuous wave operation, embodiments of the laser may operate using the following parameters. Average laser power may be selected within the range between 0.1 W to 50 W. The duration of laser pulses may be selected within the range between 1 ns to 100 ms.

In pulsed operation, embodiments of the laser may operate using the following parameters. Laser pulse duration ranges from 1 to 100 nanoseconds (ns). Peak laser power may be selected within the range between 0.5 kW to 2 MW. Laser power density may be selected within the range between 0.5 MW/mm to 1 GW/mm. Laser pulse density may be selected within the range between 1 μJ to 1 mJ. Laser pulse frequency may be selected within the range between 10 kHz to 100 MHz. Alternatively, the laser pulse frequency may be lower than 10 kHz or, in some embodiments, higher than 100 MHz. The resolution may be set between 300 and 1600 dpi, or alternatively, can be determined based on the laser light step size (i.e., a distance between pixels/dots) typically ranging from 1 μm to 20 μm (overlapping) or, in some embodiments, from 100 μm to 120 μm. Other step sizes (e.g., smaller than 1 μm or larger than 120 μm) may be used in other embodiments. A number of laser pulses per fusion location may be selected between 1 and 20 or any number up to 200 depending of the time delays between laser pulses. Embodiments of the lasers may further employ a number of passes selected between 1 and 5 to achieve proper fusion of pigments to the substrate 15; the number of passes may be determined based on the implemented software.

The apparatus 11 may also include focusing components (not shown) as for dithering or grey scale imaging, known in the art, suitable for positioning and focusing the fusing means 17*a* and 17*b*. Examples may include, but are not limited to, scanners, mirrors, F-theta lenses (e.g., 103 mm, 163 mm), beam expanders, laser beam vision devices, and the like.

The apparatus 11 further includes a computer element 27. The computer element 27 is in the nature of a computer processing unit (CPU) and supporting structures integrated into the housing and structures supporting the other elements of the apparatus or standing external. Examples of a computer element 23 include, without limitation, personal computers, mainframe computers and servers, integrated computers. The computer element 27 is in signal communication with the means for fusing means 17*a* and/or 17*b* to produce an image or text using suitable software. As used herein, the term "signal communication" refers to being wired together, or wirelessly (through electromagnetic communication in the nature of WIFI or in communication through photonic transmission). The computer element translates or processes images or text into pixels/dots, such as a raster (bitmap) format, and directs the means for fusing 17*a* to create indentations to receive pigment formulation or to fuse pigment and binder which has been applied to the substrate 15 corresponding to and forming the pixels/dots in a plurality of locations which conform with the image or text.

Figure 2:
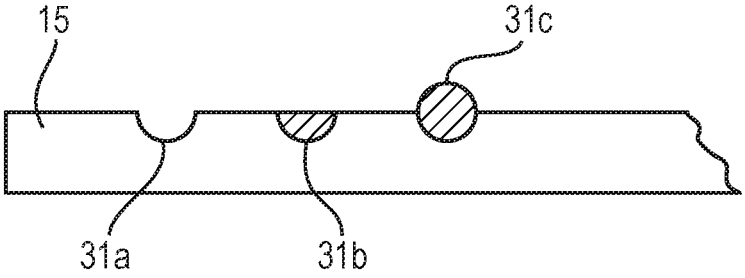
FIG. 2 is a schematic, cross-sectional illustration of an embodiment of a substrate.

Turning now to FIG. 2, a substrate 15 is depicted in cross section. An indentation 31*a* is present in the substrate 15 at the time substrate is loaded into apparatus 11, or is made by laser 17*a* under command of computer element 27. A similar indentation 31*b* depicts an indentation after receiving a formulation from application means 21*a*, 21*b* or 21*c*. Fusing and curing the formulation, caused the dyes to diffuse and initiating a reaction by laser 17*a* or by thermal treatment using a thermal drum 17*b* may create a pixel/dot 31*c* comprised of binder, polymerized reactive polymer and pigment. For example, without limitation, a typical pixel/dot 31*c* may include a size selected from the range of 1 μm-10 μm to 80 μm-120 μm. Pixel/dot embodiments may exhibit a spacing selected from the range of 1 μm-4 μm to 40 μm-120 μm. In further embodiments, the pixel/dot size is selected from the range of 20 μm-40 μm to 40 μm-60 μm and the pixel/dot spacing is selected within the range from 5 μm-20 μm to 20 μm-40 μm. In further embodiments, additional features may be represented on the substrate in non-pixel or vector formats.

Each pixel/dot includes at least one pigment and binder, unless the pixel/dot is formed by carbonization of the surface of the substrate. One embodiment features a plurality of pigments or dyes to create a range of colors (usually YCM or CMYK). The process is additive to the substrate, with the exception of the formation of pixels/dots by carbonization of the substrate surface. The pixels/dots present a raised texture above the surface of the substrate which in itself provides a means for identifying the authenticity of documents prepared by the present process.

Returning now to FIG. 1, removal means 23 removes pigment and binder that is not fused to the substrate 15 and reactive polymer and initiator that is not reacted. For example, means for applying a pigment, reactive polymer, initiator and binder 21*a*, 21*b* and 21*c* applies a first pigment, first reactive polymer, first initiator and first binder for a first color, of which a portion of first pigment and first binder is fused to the substrate 15 and first reactive polymer and first initiator form a polymeric mass in the form of a pixel/dot 35 and a portion of first pigment, first reactive polymer, first initiator and first binder remain unfused. Removal means 23 removes from the substrate 15 the unused portion. Removal means 23 may take several forms, for example, without limitation, sweeps, brushes, vacuums, electrostatic devices (e.g., one or more charged plates), and blowers. As depicted, the removal means 23 is in the form of a vacuum device. The removed first pigment, first reactive polymer, first initiator and first binder is thus available to be reapplied to the substrate 15 or a different substrate.

Means for applying a dye (and/or a pigment) and binder 21*a*, 21*b* and 21*c* may apply a first formulation having a first pigment, and a second formulation having a second pigment and a third formulation having a third pigment and other formulations sequentially. For example, without limitation, container 21*a* applies a first formulation having a first pigment, first monomer, first initiator and first binder. First pigment, first monomer, first initiator and first binder is fused to the substrate 15 in the location desired by computer element 27 with laser 17*a* and first reactive polymer and first initiator is reacted to form a first polymeric mass creating pixel/dot 35. First pigment, first reactive polymer, first initiator and first binder that is not in the location of pixel/dot 35 is unfused and not reacted The unfused first pigment, first monomer, first initiator and first binder on the surface of the substrate 15 is removed from the substrate 15 by the removal means 23. Next, a second pigment, second reactive polymer, second initiator and second binder is applied to the substrate 15. The second pigment is for a second color. Although referred herein as a second pigment, the reference, in this context, is not limited to two pigments, but applies to all subsequent pigments. It is common to work with four pigments, cyan (C), yellow (Y), magenta (M), and black (K), to create a substantially full range of colors perceptible to the human eye.

As depicted in FIG. 1, the means for applying a pigment and/or a dye comprises three containers or color ribbon panels for ribbons 21*a*, 21*b*, and 21*c*. In the event three pigments or 3 panel ribbons are used, for example cyan, yellow and magenta, apparatus 11 includes means for making one or more pixels/dots which includes a carbonized area of the substrate in lieu of, or in combination with, a black pigment. The means to produce such carbonized area includes lasers such as laser 17*a*. Laser 17*a* is be adjusted to output light suitable for dye diffusion, fusing pigments and binders or for carbonization of the surface of the substrate or initiating a reaction of reactive polymers.

In the event a fourth pigment formulation is desired, apparatus 11 has a fourth or a fifth (e.g., UV fluorescent, etc.) container (not shown) in the nature of the three containers 21*a*, 21*b* and 21*c* depicted.

In the alternative, apparatus 11 may apply a first pigment for a first color and a second pigment for a second color and other pigments concurrently. Alternatively, the apparatus 11 may transfer dyes from the same or different color ribbons. The means for applying the first pigment (and/or dye) and the second pigment (and/or dye) and other pigments concurrently, may comprise the separate containers depicted in FIG. 1, containers or ribbon color panels 21*a*, 21*b*, and 21*c* which release the formulations as the substrate passes under, a single container (not shown) which contains all the pigments and/or dyes. In the event more than one pigment and/or dye is applied to the substrate 15, the fusing means and reacting means, such as laser 17*a*, is capable of fusing the first pigment and/or dye under a first set of fusing conditions and reacting a reactive polymer with an initiator under a first set of reaction conditions and a second pigment is fused by fusing means and reacting means, such as laser 17*a*, under a second, different set of fusing conditions and reaction conditions to create pixels/dots of different colors. Although a single laser 17*a* is depicted, apparatus 11 may comprise more than one laser [not shown] each laser capable of imposing different fusing conditions and reacting conditions. For example, one laser may apply a first wavelength of light for a pixel/dot of a first pigment and be adjustable to apply a second, different wavelength of light that is applied to a second pixel/dot for a second pigment. Or, the second pigment formulation may be fused by a second laser operating at a second wavelength.

Apparatus 11 can make a substrate 15 having laser-etched marks or hollows. The formulation is placed in one or more laser-etched marks on the surface of the substrate 15 and at least a portion is fused thereto. For example, without limitation, laser 17*a* makes laser-engraved marks in the substrate 15 and means for applying a formulation 21*a* places a first pigment, reactive polymer, initiator and binder in the impression. The substrate 15 is cleared of first pigment, first reactive polymer, first initiator and first binder on its surface with the exception of the impression by removal means 23. The pigment and binder is fused to the substrate 15 by laser 17*a* or by thermal drum 17*b* and the reactive polymer and initiator are reacted by the free radical formation of the photons from laser 17*a* to form a polymeric mass.

The laser 17*a* may also be used to transfer colors from a ribbon or to soften the substrate to create one or more sticky locations or sticky laser-engraved marks which serve to retain pigment and binder prior to fusing by further laser applications or by thermal drum 17*b*. Substrate 15 may have laser-engraved marks premade for receiving a formulation. Only laser-engraved marks processed by the laser 17*a* would retain pigment and binder and form a pixel/dot. Similarly, when the substrate has a non-etched flat surface, only laser-engraved marks processed by the laser 17*a* would allow one or more colors from the ribbon(s) to be transfer to the substrate.

Although three containers 21*a*, 21*b*, and 21*c* are depicted in FIG. 1, the apparatus may contain any number of containers or color panels for ribbons and/or conduits to deliver formulations to the substrate 15. The formulations may be compounds or be directed to special application methods to effect further security features. For example, without limitation, the apparatus 11 can fuse, transfer or react reactive polymers such that one or more selected pigments appear when viewed at certain angles and not at other angles. In further embodiments, the formulations may include one or more fluorescent compounds which can be identified under certain defined illumination or viewing conditions.

Apparatus 11 is depicted in FIG. 1 without a housing or cover for purposes of clarity. Those skilled in the art will recognize that apparatus 11 would further comprise an appropriate housing to support, contain and shield the components described.

Figure 3:
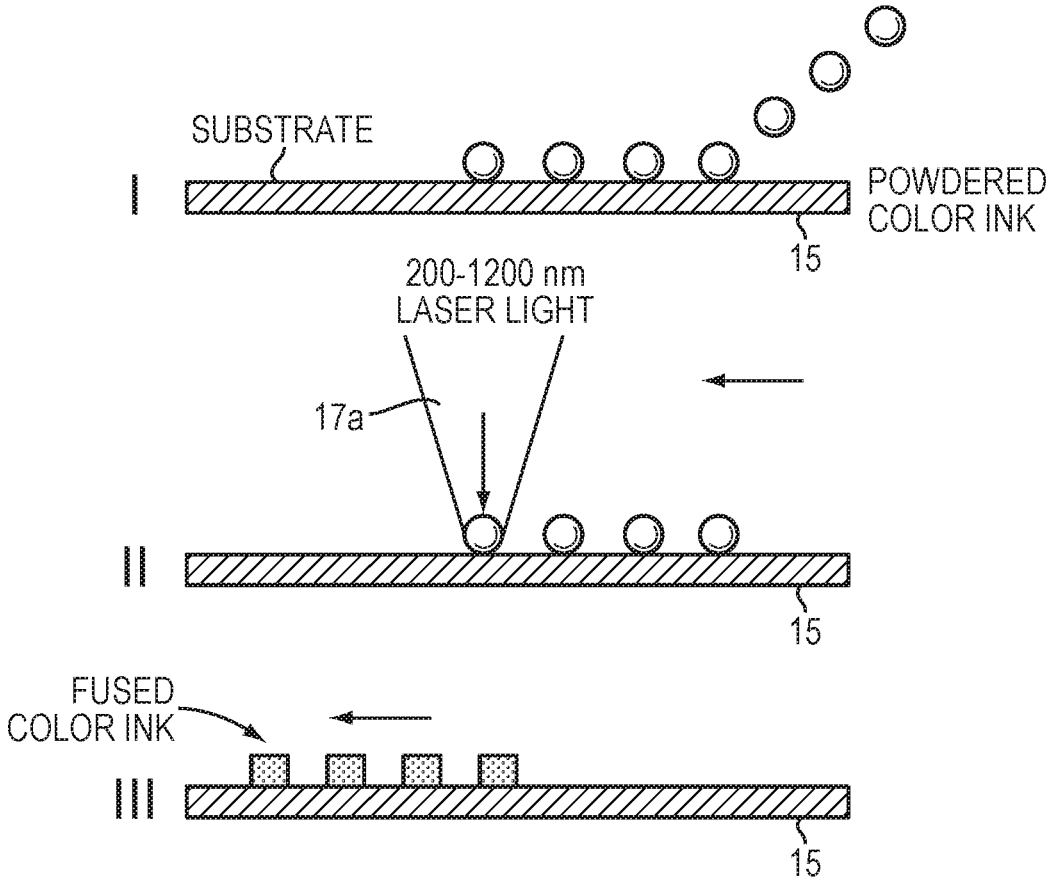
FIG. 3 is a schematic illustration of an embodiment of a first method the present disclosure.

The operation of apparatus 11 will now be described in the context of a method of placing an image or text on a substrate 15. Turning now to FIG. 3, one method of the present invention is illustrated in schematic form. As used in FIGS. 3-5, the letter "Y" depicts a yellow pigment and/or dye, the letter "C" represents a cyan pigment, and/or dye the letter "M" represents a magenta pigment and/or dye and the letter "K" represents a black pigment and/or dye. The method includes the step of applying a formulation including one or more binders, one or more reactive polymers, one or more initiators and one or more pigments to a substrate 15, in Roman Numeral I. The substrate 15 has a composition selected from the group of polymers or mixtures of polymers consisting of polycarbonates (PC), polyvinylchloride (PVC), polyethylene terephthalate (PET), modified polyethylene (PE), polypropylene (PP), polyamides (PA) and polytetrafluoroethylene (PTFE). The binders have a composition selected from one or more polymers or mixtures of polymers consisting of polystyrene (PS), polymethylmethacrylate (PN/WIA), polyvinyl alcohol (PVA), polyacrylics (PA), and polyurethanes (PU) and other similar, polymers transparent to visible light. The one or more pigments have a composition selected from the group consisting of inorganic and insoluble hybrid inorganic-organic color products. The reactive polymers have a composition selected from the group polymers or mixtures of polymers consisting of polycarbonates (PC), polyvinylchloride (PVC), polyethylene terephthalate (PET), modified polyethylene (PE), polypropylene (PP), polyamides (PA) and polytetrafluoroethylene (PTFE). The initiators have a composition selected from the group 2-hydroxy-2-methyl propiophenone, 2-hydroxy-4'-(2-hydroxyethoxy)-2-methyl propiophenone, 1-hydroxycyclohexyphenyl ketone, methylbenzoyl formiate, diphenyl (2,4,6-trimethylbenzoyl)-phosphine oxide, phosphine oxide, phenyl bis (2,4,6-trimethyl benzoyl), 2-methyl-1 (methylthio)phenyl]-2-(4-morpholinyl)-1-propanone, 2-benzyl-2-(dimethyl amino)-1-(4-morpholinyl) phenyl]-butanone, 2-dimethyl amino-2-(4-methyl-benzyl)-1-(4-morpholin-4-yl-phenyl)-butanone, bis(ε-5-2,4-cyclopentadiene-1-yl)-bis (2,6-difluoro-3-(1-H-pyrrole-1-yl)-phenyl)titanium, 2-isopropyl thioxanthone, 2-ethyl anthraquinone, 2,4-diethyl thioxanthone, benzyl dimethyl ketal, benzophenone, 4-chlorobenzophenone, methyl-2-benzoyl benzoate, 4-phenyl benzophenone, 2,2'-bis(2-chlorophenyl)-4,4',5,5'-tetraphenyl-1,2'-bi-imidazole, 2,2',4-tris(2-chlorophenyl)-5-(3,4-dimethoxyphenyl)-4',5'-diphenyl-1,1'-diimidazole, 4-phenoxy-2,2'-dichloroAcetophenone, ethyl-4-(dimethyl amino)benzoate, isoamyl 4-(dimethyl amino)benzoate, 2-ethyl hexyl-4-(dimethyl amino) benzoate, 4,4'-bis(diethylamino) benzophenone (Michler's ethyl ketone), 4-(4'-methylphenylthio)-benzophenone, 1,7-bis(930 acridinyl) heptane and N-phenyl glycine.

The method further includes the step of fusing, dye diffusing and/or curing the one or more binders and one or more pigments to the substrate 15 with photonic and/or thermal energy and reacting the one or more reactive polymer with a free radical polymerization reaction with the initiator activated by the photons from the laser to form a polymeric mass in an image or text as depicted in Roman Numeral II. As depicted, the apparatus 11 provides photonic energy with laser 17*a*. Roman Numeral III illustrates the fixed color image on the substrate 15.

Figure 4:
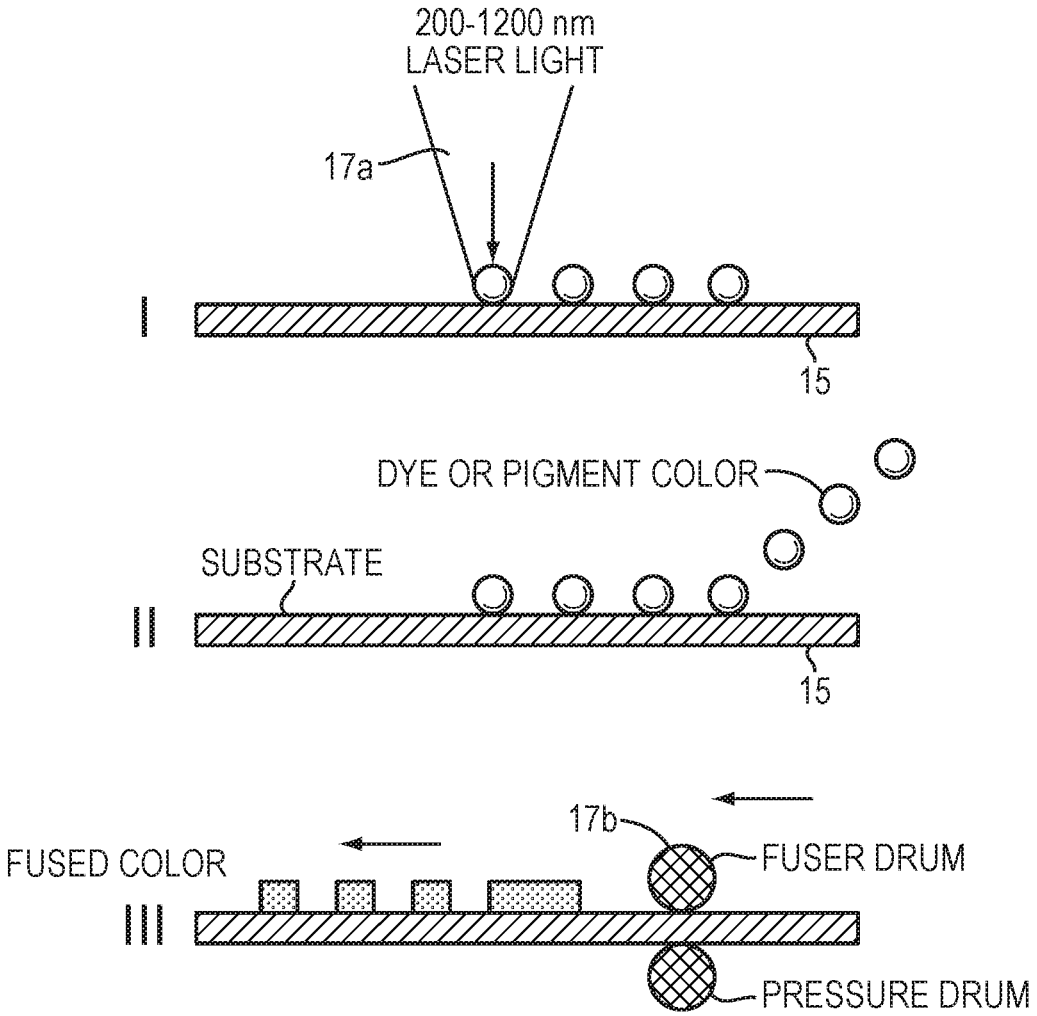
FIG. 4 is a schematic illustration of an embodiment of a second method of the present disclosure.

A further method is depicted in FIG. 4. In Roman Numeral I, laser 17*a* prepares the surface of substrate 15 to soften and/or form a hollow or impression to receive a formulation of pigment and/or dye from a ribbon, reactive polymer, initiator and binder. The formulation is applied to the substrate 15 in Roman Numeral II. In Roman Numeral III, a formulation comprised of pigments and/or dyes, reactive polymer, initiator and binders not fixed to the substrate in Roman Numeral II are cleared by removal means [not shown in this Figure]. In Roman Numeral IV, the pigment reactive polymer and binder of the fixed formulation are fused to the substrate 15 by thermal drum 17*b* forming a pixel/dot. Of course, the steps of this process are intended to form a plurality of pixels/dots and only one pixel/dot is described for the purposes of clarity.

Turn now to FIG. 5, which depicts a further method of the present invention. Roman Numeral I depicts an application means 21*a* depositing one or more pigments, one or more reactive polymers, one or more initiators and one or more binders in a liquid or aerosol. The laser 17*a* is tuned to a wavelength to which the black pigment readily absorbs and is heated to fix to the substrate 15. Roman Numeral II depicts laser 17*a* tuned to a wavelength to which the cyan pigment readily absorbs and is heated to fix to the substrate 15. Roman Numeral III depicts laser 17*a* tuned to a wavelength to which the magenta pigment readily absorbs and is heated to fix to substrate 15. And, Roman Numeral IV depicts laser 17*a* tuned to a wavelength to which the yellow pigment readily absorbs and is heated to fix to the substrate 15. These fixed pigments are fused to the substrate by thermal devices, such as a thermal drum or a lamp 17*b* (not shown in this figure) and/or lasers such as laser 17*a*. The reactive polymers and initiators are reacted in a free radical reaction to form a polymeric mass. The fused pigments and polymeric mass form pixels/dots, which pixels/dots comprise one or more images or text.

One embodiment of the method features the step of forming an image or text including one or more pixels/dots. The method includes controlling the means for fusing to fuse or diffuse said one or more pigments and or/dye and reacting one or more polymer and one or more initiators to for a polymeric mass forming one or more pixels/dots on the substrate to produce the image or text. One embodiment features means for fusing and reacting under the control of a computer element. The computer element processes the images and text to be placed on the substrate, where the images and text include one or more pixels/dots. The pixels/dots include one or more areas of substrate having a pigment set in a binder fused and or bound to a polymeric mass to a surface of the substrate.

The unfused binder, reactive polymer, initiator and pigment is removed from the substrate. The unfused pigment, reactive polymer, initiator and binder are recycled for further use. The method above may substitute a step fixing a black pigment and binder to substrate by making one or more pixels/dots through a carbonization of a pixel/dot area of the substrate.

The method features a substrate 15 having one or more laser-etched marks to receive a pigment and binder. The laser-etched marks may be pre-formed in the substrate or made by lasers, such as laser 17*a*. The one or more pigments, one or more reactive polymers, one or more initiators and binders are fused in the laser-etched marks to form one or more pixels/dots. The substrate 15 may further comprise an activation agent on the substrate surface, as a surface a layer or integral throughout the substrate.

The formulations of the present method further include additional ingredients and compositions to place personalized features on the substrate. For example, without limitation, one method features a formulation including a fluorescent compound, which can be used with a pigment or without a pigment. One or more pixels/dots include a fluorescent compound to impart a security identification feature. In further embodiments of the method, 25 the pigments may be fused to the substrate such that one or more selected pigments appear when viewed at certain angles and not at other angles.

The finished substrate 15 bearing the image or text includes one or more pixels/dots formed of the fused pigments and binders in the polymeric mass. The binders, polymeric mass and pigments form a mass having a depth extending 0.1 mm to 1 mm from the surface mean and an elevation extending 0.1 mm to 1 mm above the surface mean. The pixels/dots may also include a carbonized area of the substrate.

Figure 6:
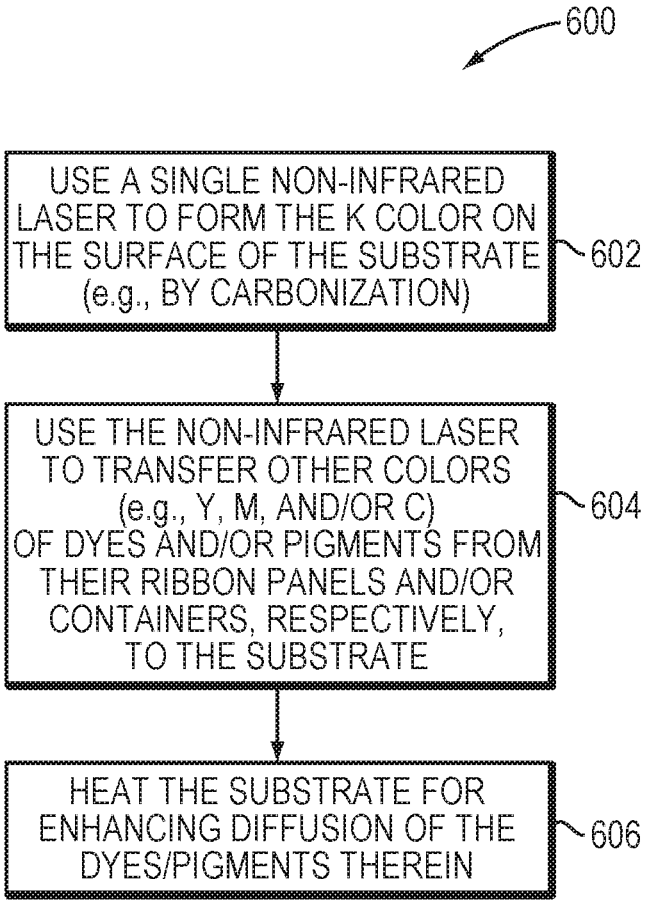
FIG. 6 is a flow chart illustrating an approach for creating a full-color image in an identification document in accordance with various embodiments.

FIG. 6 is a flow chart illustrating an approach 600 for creating a full-color image in an identification document (e.g., a driver's license or passport) by combining laser marking and laser transfer with dye or pigment diffusion in a substrate (e.g., PC). In a first step 602, the K color is formed by carbonization of the surface of the substrate using a single non-infrared laser. For example, the laser may be a green laser operating at 532 nm or an ultraviolet laser operating at 355 nm. In a second step 604, the green/UV laser may transfer other colors (e.g., Y, M, and/or C) of dyes and/or pigments from their ribbon panels and/or containers, respectively, to the substrate. In some embodiments, the laser settings (e.g., the power, frequency, pulse number, pulse duration, spot size, image resolution, and/or step size) and/or the optical absorption properties of the dyes/pigments are adjusted such that the color properties substantially match the laser properties; different laser settings may be necessary for different colors. For example, the laser having a power in the range of 1 mW to 500 mW and a pulse duration less than 30 ns may be sufficient to transfer the Y, M and/or C colors to the substrate without undesired markings. Additional examples are described in the examples below. In a third step 606, the substrate is heated for enhancing diffusion of the dyes/pigments in the substrate. Preferably, the heating step 606 is performed after the laser transferring step 604, but in some embodiments, step 606 may be performed prior to or during step 604. Preferably, the substrate is heated to a glass-transition temperature associated with the material made of the substrate (e.g., 140° C. for PC); this may be achieved using a conventional, conductive or radiative heat source.

Accordingly, various embodiments advantageously enable a single laser source to effectively transfer various colors of dyes/pigments onto a substrate and enhance their diffusion in the substrate so as to create high-quality images.

The features of the present method, apparatus, substrate, finished substrate and formulations are further exemplified in the following examples.

Example 1

This example features a substrate constructed and arranged in the size and form of an ID (identification) card by a dry ink (binder encapsulated pigments) powder. The substrate has a composition of polyvinylchloride (PVC) or polycarbonate (PC). A layer of formulation comprising one or more pigments and binders is placed on the substrate. This example features a substrate constructed and arranged in the size and form of an ID The binders have a composition selected from one or more polymers or mixtures of polymers consisting of polyvinyl alcohol (PVA) and polyacrylics (PA). The one or more pigments have a composition selected from the group consisting of $TiO_2$, phthalocyanine, and a security additive. An image and text are selected in a computer program Symbol Writer Pro (RMI Laser, LLC, CO, USA) and the image and text are translated by the software into a pattern of pixels/dots. The computer is programmed to execute the pattern of pixels/dots on a fiber laser UF-20 at 1070 nm wavelength operating at a Q-switched pulsed mode.

Upon execution, the laser fixes and fuses the pigment and binder for each of the CMYK colors of the formulation to the substrate. The laser system has a scanner and a 163 mm F-Theta lens tuned at step size 14, pulse repetition set on 2, laser operating at 30 kHz frequency and 80% power in one pass at fast raster option. The substrate has a well-defined image and text to the naked eye and under magnification of 5 to 20 times.

In various embodiments, the laser directly writes e.g., "SAMPLE" in yellow on the image) by changing the surface chemistry without applying pigments. If the K color has been created on the PC substrate (e.g., by the known surface carbonization process or laser-marked, the colors applied thereon may be darker due to residual marking, fixing colors and binders.

Images and text in color and in black and white (B/W) are embedded into the bulk in a way that when the card is destroyed, the card personalization information on both PC and PVC substrates is removed (or at least unrecognizable). The combination of direct colors and the described formula dry ink introduced by the laser provides an additional security protection feature to the personalization card. In addition, the laser can be easily tuned to produce tactile personalization information in color and in B/W to enhance the document security.

Example 2

This example features a substrate constructed and arranged in the size and form of a DL (driving license) card by dry ink (binder encapsulated CMYK pigment powders). The substrate has a composition of polyvinylchloride (PVC). A layer of formulation comprising one or more pigments and binders is placed on the substrate. The binders have a composition selected from one or more polymers or mixtures of polymers consisting of polystyrene (PS) and polymethylmethacrylate (PMMA). The one or more pigments have a composition selected from the group consisting of ZnO, quinacridone, and a security additive. An image and text are selected in a computer program Symbol Writer Pro (RMI Laser, LLC, CO, USA) and the image and text are translated by the software into a pattern of pixels/dots. The computer is programmed to execute the pattern of pixels/dots on a laser U-1 or UM-1 at 1064 nm wavelength operating at a Q-switched pulsed mode.

Upon execution, the laser fixes and fuses the pigment and binder of the formulation to the substrate. The laser system has a scanner and a 163 mm F-theta lens tuned at step size 20, pulse repetition set on 2, laser operating at 40 kHz frequency and 100% power in one pass at fast raster option. The substrate has a well-defined image and text to the naked eye and under magnification of 5 to 10 times.

Image and text in color and in B/W are embedded into the bulk in a way when the card is destroyed, the card personalization information is removed (or at least unrecognizable). In addition, the laser may be easily tuned to produce tactile personalization information in color and in B/W to enhance the documents security.

Example 3

This example is meant to manufacture a standard ID card using the laser 17*a* and laser-transferring dyes from one or more ribbons. In various embodiment, the laser 17*a* is a green laser having a wavelength approximately 532 nm. The substrate used in this example is Polycarbonate (PC). The images and text on these cards are imported/created using a computer program called WinLase (Lanmark Controls Inc., MA, USA) and are then translated by the software into a pattern of pixels/dots. These pixels/dots are then actualized by a SCANcube III 14 (ScanLab, Munich, DE). The beam which feeds into the SCANcube is initially passed through a quartz 5× fixed beam expander (Sill Optics, Wendelstein, DE) from a Nanio Air 532 nm-10V DPSS laser operating at the Q-switched mode.

For a full-color image, individual layers are transferred to the PC substrate in a K-Y-M-C order. Y, M, and C are the result of laser transferred dyes from one or more dye ribbons to the PC substrate, whereas K is directly etched into the surface of the PC card through, for example, carbonization. K is marked through a transparent overlay section of the film at 635 DPI, having a 300 μs time delay, and using a single pulse, single mark, at 20 kHz, with 39.00% power in the ignore black pixel mode. Y is then marked through the corresponding yellow section of the film at 735 DPI, having a 100 μs time delay, and using a single pulse, single mark, at 20 kHz, with 35.50% power in the ignore black pixel mode. M is then marked through the corresponding magenta section of the film at 535 DPI, having a 300 μs time delay, and using a single pulse, single mark, at 20 kHz, with 30.25% power in the normal mode. C is last marked through the corresponding cyan section of the film at 635 DPI, having a 150 μs time delay, and using a single pulse, single mark at 20 kHz, with 30.50% power in the normal mode. The text is marked into the surface in the same manner as the K segment above but is a vector file rather than a dot matrix.

In order to fix the colors and to enhance the diffusion of YCM dyes (K is marked on the substrate already) into the bulk of the card substrate, it may be beneficial to heat up the substrate to the glass transitional temperature ($T_g$) of the PC polymer (about 140-145° C.); this typically takes no more than 10-12 secs using a radiation non-contact heat source.

The laser color transfer is a non-impact process and is different from the thermal transfer of colors by a thermal head that is a contact process called $D_2T_2$ (Dye Diffusion Thermal Transfer). The known $D_2T_2$ simultaneous thermal transfer and diffusion process does not allow full diffusion of dyes into the bulk of the substrates. All thermal head printers need an additional overlay protection. Ribbon panels usually have OYMCK, where O is overlay. Thermal transfer typically does not apply when PC substrates are used. Various embodiments of the present invention, however, do not need the additional card surface protection using an overlay or a lamination; in addition, only three (YMC) color panels are required in the ribbon(s).

In some embodiments, image and text in color and in B/W are embedded into the substrate bulk such that when the card is destroyed, the personalization information is removed (or at least rendered unrecognizable). The laser is easily tuned to produce tactile personalization information of K (black) color for enhancing the documents security. There is a chemical resistance in many common solvents (such as water, alcohols, different oils etc.) but not in solvents that dissolve the PC polymer. As a resulting, it may be easy to destroy information recorded on the PC substrate surface by using solvents (such as diethyl ether, chloroform etc.), thereby rendering the cards to have no (or at least limited) use. Further, because various embodiments utilizing laser-marking to create the K color of the images and the text that is visible and/or readable, this feature may enhance the document security.

Example 4

This example is meant to demonstrate an identification on a passport having a full-color image created using, for example, a green (e.g., 512 nm) laser and one or more dye ribbons. The substrate used in this example is Polycarbonate (PC). The image on the substrate in the passport is imported/created using a computer program called WinLase (Lanmark Controls Inc., MA, USA) and are then translated by the software into a pattern of pixels/dots. These pixels/dots are then actualized by a SCANcube III 14 (ScanLab, Munich, DE). The beam which feeds into the SCANcube is initially passed through a quartz 5× fixed beam expander (Sill Optics, Wendelstein, DE) from a NANIO AIR 532 nm-10V DPSS laser operating at the Q-switched mode. The output from the hurrySCAN device is fed through a special lens before being able to cover a 5-by-5 inches area impinging upon a ribbon/substrate placed on a stage beneath it.

For a full-color image, individual layers are transferred to the PC substrate in a K-Y-M-C order. Y, M, and C are the result of transferred dyes from one or more dye ribbons to the PC substrate, whereas K is directly etched into the surface of the PC substrate through, for example, carbonization. K is marked through a transparent overlay section of the film at 635 DPI, having a 300 μs time delay, and using a single pulse, single mark, at 20 kHz, with 39.00% power in the ignore black pixel mode. Y is then marked through the corresponding yellow section of the film at 735 DPI, having a 100 μs time delay, and using a single pulse, single mark, at 20 kHz, with 35.50% power in the ignore black pixel mode. M is then marked through the corresponding magenta section of the film at 535 DPI, having a 300 μs time delay, and using single pulse, single mark, at 20 kHz, with 30.25% power in the normal mode. C is last marked through the corresponding cyan section of the film at 635 DPI, having a 150 μs time delay, and using a single pulse, single mark. at 20 kHz, with 30.50% power in the normal mode.

In order to fix the colors and to enhance the diffusion of YCM dyes (K is marked on the substrate already) into the bulk of the card substrate it may be beneficial to heat up the substrate to the glass transitional temperature ($T_g$) of the PC polymer (about 140-145° C.); this typically takes no more than 10-12 secs with a radiation non-contact heat source.

Image and text in color and in B/W are embedded into the substrate bulk in a way that when the substrate is destroyed, the personalization information is removed (or at least unrecognizable). The laser is easily tuned to produce tactile personalization information of K (black) color for enhancing the documents security. No additional protection such as the overlay for thermal head printing or lamination is needed. There is a chemical resistance in solvents (such as water, alcohols, different oils etc.) but not in solvents that can dissolve the PC substrates. Therefore, destroying the PC substrate surface using solvents (such as diethyl ether, chloroform etc.) may also remove information recorded on the substrate. Further, because the marked K color of the images and text are still visible and readable, this may provide an addition security feature to the passport.

Example 5

This example is meant to demonstrate data identification including a full-color image on a card and a passport using a green 532 nm laser and one or more pigment ribbons. The substrate used in this example is Polycarbonate (PC). The image on the card/passport is imported/created using a computer program called WinLase (Lanmark Controls Inc., MA, USA) and are then translated by the software into a pattern of pixels/dots. These pixels/dots are then actualized by a SCANcube III 14 (ScanLab, Munich, DE). The beam which feeds into the SCANcube is initially passed through a quartz 5× fixed beam expander (Sill Optics, Wendelstein, DE) from a Nanio Air 532 nm-10V DPSS laser operating at the Q-switched mode. The output from the hurrySCAN device is fed through a special lens before being able to cover a 5 by-5 inches area impinging upon a ribbon/substrate placed on a stage beneath it.

For a full-color image, individual layers are transferred to the substrate in a K-K-Y-Y-M-M-C order. Y, M, and C are the result of laser transferred dyes from one or more of the pigment ribbons to the substrate, whereas K is directly etched into the surface through carbonization. K is marked without an overlay at 635 DPI, having a 300 μs time delay, and using a single pulse, at 60 kHz, with 55% power in the pulse-tracked Q-switched mode. K, unlike the monochrome C/M/Y, is grayscale and its pulse length is interpolated across 100 points that start from 4.6 μm with the grayscale value of 3.55 and increase linearly until hitting 12 μm and ending at the grayscale value of 255. C, M, and Y each have the same pulse length of 8 μm. After the second K is marked, Y is then marked twice through two different segments of the yellow pigment ribbon at 635 DPI, having a 300 μs time delay, and using a single pulse, at 60 kHz, with 60% power in the pulse-tracked Q-switched mode. M is then marked twice through two different segments of the magenta pigment ribbon section at 635 DPI, having a 300 μs time delay, and using a single pulse, at 60 kHz, with 60% power in the pulse-tracked Q-switched mode. C is then marked last through the corresponding cyan section of the pigment ribbon at 635 DPI, having a 300 μs time delay, and using a single pulse, at 60 kHz, with 60% power in the pulse-tracked Q-switched mode. The text is marked into the surface in the same manner as the K segment described above but is a vector file rather than a dot matrix and is only marked once rather than twice.

Depending on the particle sizes of the pigments, fixation by heat may not be applicable. Thus, in order to protect the YCM colors of the pigment ribbons (K is marked on the substrate already), in various embodiments, an overlay coating or lamination protection may be employed. The preferable protection is a UV coating; for example, an in-line UV coating section may be implemented in the printer that includes a UV coater and a UV LED flash. The UV coating may provide additional durability and chemical resultants with a glass-like top finish on the substrate. UV coating for enhancing surface protection may be utilized in any approaches described above for manufacturing the ID cards and passports.

Further, a custom-made pigment ribbon that combines the advantages of dry polymer pigment inks with the ribbon panels may be used to attach the colors to the substrate. This intermediate process works better with the NIR lasers because of the necessary laser pulse to deliver and the necessary heat. Both lasers (NIR laser having a wavelength of 1064 nm and green laser having a wavelength of 532 nm) are easily tuned to produce tactile personalization info to enhance the document's security.

Example 6

This example is meant to manufacture a standard ID card by a UV (e.g., 355 nm) laser that can transfer colors from one or more dye and/or pigment based ribbons. The substrate used in this example is polycarbonate (PC). The UV laser operating conditions (e.g., the current, beam operating mode, trigger conditions, etc.) are controlled by a computer program called Matrix Customer Software (Coherent, Palo Alto, Calif.). The image and text on these cards is imported/created using a computer program called LaserDesk (ScanLab, Munich, DE) and are then translated by the software into a pattern of pixels/dots. These pixels/dots are then actualized by a hurrySCAN III 10 (ScanLab, Munich, DE). The beam which feeds into the hurrySCAN is output from a Matrix 355-1-60 Solid State laser operating at the Q-switched pulsed mode. The output from the hurrySCAN device is fed through a 160 mm lens before impinging upon a ribbon/substrate placed on a stage beneath it.

For a full-color image, individual layers are transferred to the PC substrate in a K-K-Y-Y-M-M-C order. Y, M, and C are the result of laser transferred dyes/pigments from the pigment or dye ribbons to the PC substrate, whereas K is directly etched into the surface of the PC card through carbonization. K is marked without an overlay at 635 DPI, having a 300 μs time delay, and using a single pulse, at 60 kHz, with 55% power in the pulse-tracked Q-switched mode. K, unlike the monochrome colors C/M/Y, is grayscale and its pulse length is interpolated across 100 points that start from 4.6 μm with the grayscale value of 3.55 and increase linearly until hitting 12 μm and ending at the grayscale value of 255. C, M, and Y each have the same pulse length of 8 μm. After the second K is marked, Y is then marked twice through two different segments of the yellow pigment ribbon at 635 DPI, having a 300 μs time delay, and using a single pulse, at 60 kHz, with 60% power in the pulse-tracked Q-switched mode. M is then marked twice through two different segments of the magenta pigment ribbon section at 635 DPI, having a 300 μs time delay, and using a single pulse, at 60 kHz, with 60% power in the pulse-tracked Q-switched mode. C is then marked last through the corresponding cyan section of the pigment ribbon at 635 DPI, having a 300 μs time delay, and using a single pulse, at 60 kHz, with 60% power in the pulse-tracked Q-switched mode. The text is marked into the surface in the same manner as the K segment described above but is a vector file rather than a dot matrix and is only marked once rather than twice.

In order to fix the colors and to enhance the diffusion of YCM dyes (K is marked) into the bulk of the card substrate, it may be beneficial to heat up the substrates to the glass transitional temperature ($T_g$) of the PC polymer (about 140-145° C.); this typically takes no more than 10-12 secs with a radiation non-contact heat source. Image and text in color and in B/W are embedded into the substrate bulk in a way that when the card is destroyed, the personalization information on the cared is removed. The laser is easily tuned to produce tactile personalization information of K (black) color for enhancing the documents security. No additional protection such as the overlay for thermal head printing or lamination is needed. There is a chemical resistance in some solvents (such as water, alcohols, different oils etc.) but not in solvents that can dissolve the PC substrates. Therefore, after damaging the substrate surface by the solvents (such as diethyl ether, chloroform etc.), information recorded on the substrate may be removed. Further, because the marked K color of the images and text are visible and readable, this may provide another feature for enhancing the document security.

To increase durability, in various embodiments, a UV coating may be applied. For example, an in-line UV coating section may be implemented in the printer that include the UV coater and UV LED flash lamp. For creating a glass-like top finish on the personalized substrate. A UV coating for enhancing surface protection may be utilized in any approaches described above for manufacturing the ID cards or passports data page personalization methods.

Example 7

This example features a substrate constructed and arranged in the size and form of a credit card. The substrate has a composition of fire resistive, filler modified cross linked polyethylene (PE). A layer of formulation comprising one or more pigments and binders is placed on the substrate. The binders have a composition selected from one or more polymers or mixtures of polymers consisting of polyacrylics mixture and polyurethanes. The one or more pigments have a composition selected from the group consisting of carbon black, and a security additive. An image and text are selected in a computer program Symbol Writer Pro (RMI Laser, LLC, CO, USA) and the image and text are translated by the software into a pattern of pixels/dots. The computer is programmed to execute the pattern of pixels/dots on a YAG laser U-1 at 1064 nm wavelength operating at the Q-switched pulsed mode.

Upon execution, the laser fixes and fuses the pigment and binder of the formulation to the substrate. The laser system has a scanner and a 163 mm F-theta lens tuned at step size 10, pulse repetition set on 2, laser operating at 10 kHz frequency and 90% power in one pass at fast raster option. The substrate has a well-defined image and text to the naked eye and under magnification of 5 to 30 times.

Secure credit card samples are best made using laser dye transfer and application of radiation heat on the substrate up to the glass transition temperature (e.g., 140° C. for PC substrates and also works for PVC, PVC/PET and other commercially available card substrates) for dye fixation.

Example 8

This example features using lasers having different wavelengths to irradiate pre-deposited dry ink (e.g., CMY powders) all together. The substrate used was polycarbonate (PC) for marking the K color only. A layer of formulation comprising one or more pigments and binders is placed on the substrate for absorbing particular wavelengths different from the laser wavelengths. NIR, Green and UV lasers with the software as described in previous examples have been used in the following conditions for a dry powder CMY pigment and toner separation by colors; the green laser (532 nm) clearly separates the C color from other colors.

Green 532 nm laser: image—35.00% intensity, 20 kHz, 635 DPI, 50 μs jump delay; text—55.00% intensity, 50 kHz, raster.

NIR 1070 nm (Fiber) laser: image—10.00% intensity, 635 DPI, 20 kHz; main text—75% intensity, 20 kHz, vector, 2× mark; second text—40% intensity, 20 kHz, vector, 1× mark.

NIR 1064 nm (YAG) laser: image—40% intensity, 635 DPI, 20 kHz; second image—20% intensity; sample text—40% intensity, 20 kHz, vector, 1× mark.

UV laser: image—60% intensity, 635 DPI, 60 kHz, 8 μs pulse length; text—60% intensity, 60 kHz, vector.

By additional tuning of the ink and toner compositions with corresponding laser parameters, it may be possible to create an image or text where the main effect is K marking and other colors are either incomplete or have color separations. This phenomenon is observed using the NIR laser with parameters listed above.

In addition, a different 808 nm NIR laser having a direct diode array packed in a Leonardo Optical Module from Intense, NJ were operated by a Lab View Run Engine at a DAC current about 200 A. There was not any effect (not even a slight K marking) on the PC substrate using this laser diode array until the surface was coated by a wavelength absorbing layer. This wavelength alloys worked for the cyan color only, and in some embodiments, also worked for a green phthalocyanine based pigment because of the good laser absorption at 808 nm and the capability of creating a bitter color separation (although magenta color also absorbed slightly and are thereby combined with cyan to form Brown).

The described fusing and attaching ink and toner CMY colors on the substrates by adjusting the material composition of the substrates and tuning the laser parameters may provide unique and almost non-reproducible recording in colors; this may create another unique security feature for ID document personalization.

Example 9

This example describes ID document personalization using a UV 355 nm laser that can simultaneous perform both recording and curing process in one step. In one embodiment, UV curable color liquid inks and polycarbonate (PC) substrates were used. The K color is directly marked by the UV laser and the CMY color dyes or pigments are transferred from the UV liquid inks. Alternatively, a polyvinylchloride (PVC) may be used in conjunction with CMYK color inks. A commercially available photopolymer Visijet SL normally used for 3D printing may be used as a binder and may be pre-mixed with Clariant pigments until the CMYK colors (or other colors such as green) are created. Thin ink layers were redeposited on substrates and after recording and curing, the residual non-cured material was collected for future use.

The UV laser operating conditions (e.g., the current, beam operating mode, trigger conditions, etc.) are controlled using a computer program called Matrix Customer Software (Coherent, Palo Alto, Calif.). The image and text on these cards is imported/created in a computer program called LaserDesk (ScanLab, Munich, DE) and are then translated by the software into a pattern of pixels/dots. These pixels/dots are then actualized by a hurrySCAN III 10 (ScanLab, Munich, DE). The beam which feeds into the hurrySCAN is output from a Matrix 355-1-60 Solid State laser operating at the Q-switched pulsed mode. The output from the hurrySCAN device is fed through a 160 mm lens before impinging upon a ribbon/substrate placed on a stage beneath. The laser parameters for printing were 60% power, pulse-tracked Q-Switched mode, 0.035 mm single hatching, 20 kHz frequency, 1 m/s mark speed and 3 m/s jump speed.

Using the photopolymer as a binder for these settings advantageously allows for a fast printing/curing process. Even when the laser settings are varied drastically, the printing quality may still be good as far as colors are adhered to the card. The adhesion during this UV recoding and curing process is very strong and this recording in different colors is tactile, different from tactile personalization by laser marking. The heights of this UV cured relief is controllable and can reach different values; but when the relief are too high, the recording process may be slowed down. All these not previously known features provide an additional level of security to the ID documents; as a result, it may be difficult or impossible to create faked documents or reproduce the documents with any known methods.

Thus, we have described what are considered the preferred embodiments of the invention with the understanding that the present description is capable of modification and alteration by those skilled in the art. Therefore, the present invention should not be limited to the description above but should encompass the subject matter of the claims which follow and their equivalents.

What is claimed is:

1. A method of manufacturing a personalized identification document, the method comprising the steps of:

providing a polymeric substrate for the identification document;

carbonizing the polymeric substrate with a carbonization laser so as to generate non-removable blackened marks thereon;

providing a plurality of panels or containers, each having a dye or a pigment therein;

sequentially activating a green laser operating at substantially 532 nm or an ultraviolet laser operating at substantially 355 nm to transfer, to the substrate, a first dye or pigment from a first one of the panels or containers and then to transfer, to the substrate, a second dye or pigment from a second one of the panels or containers, the second dye or pigment in the second panel or container having a second color different from a first color of the first dye or pigment in the first panel or container; and thereafter, simultaneously heating all of the polymeric substrate to a glass-transition temperature of the polymeric substrate so as to cause the first and second dyes or pigments to diffuse into the substrate.

2. The method of claim 1, wherein the panels or containers have therein a yellow-color dye or pigment, a magenta-color dye or pigment, and a cyan-color dye or pigment only.

3. The method of claim 1, wherein the carbonization laser is the green laser or the ultraviolet laser.

4. The method of claim 1, wherein the substrate is heated via thermal convection, conduction or radiation.

5. The method of claim 1, further comprising, prior to activating the green laser or the ultraviolet laser, determining and adjusting at least one parameter associated with the green laser or the ultraviolet laser based at least in part on absorbing wavelengths of the first and second dyes or pigments.

6. The method of claim 5, wherein the parameter comprises at least one of a power, a frequency, a pulse number, a pulse duration, a spot size, an image resolution, or a step size.

7. The method of claim 1, wherein the polymeric substrate consists essentially of polycarbonate.

8. The method of claim 1, further comprising generating tactile personalization information on the substrate.

9. The method of claim 8, wherein the tactile personalization information is generated using the green laser or the ultraviolet laser.

10. Apparatus for manufacturing a personalized identification document, the apparatus comprising:

means for supporting a polymeric substrate for the identification document;

a laser for carbonizing the polymeric substrate so as to generate a non-removable layer having a black color thereon;

means for supporting a plurality of panels or containers, each having dye or a pigment therein;

a green laser operating at substantially 532 nm or an ultraviolet laser operating at substantially 355 nm for transferring, to the substrate, a first dye or pigment from a first one of the panels or containers and thereafter a second dye or pigment from a second one of the panels or containers, the dye or pigment in the second panel or container having a second color different from a first color of the dye or pigment in the first panel or container; and means for simultaneously heating all of the polymeric substrate to a glass-transition temperature of the polymeric substrate so as to cause the first and second dyes or pigments to diffuse into the substrate, the heating means being different from the carbonizing laser, the green laser, and the ultraviolet laser.

11. The apparatus of claim 10, wherein the panels or containers comprise therein a yellow-color dye or pigment, a magenta-color dye or pigment, and a cyan-color dye or pigment only.

12. The apparatus of claim 10, wherein the carbonizing laser is the green laser or the ultraviolet laser.

13. The apparatus of claim 10, wherein the polymeric substrate consists essentially of polycarbonate.

14. The apparatus of claim 10, further comprising means for generating tactile personalization information on the polymeric substrate.

15. The apparatus of claim 14, wherein the means for generating tactile personalization information comprises the green laser or the ultraviolet laser.

16. The method of claim 1, wherein:

the blackened marks are disposed within a carbonized region of the substrate;

diffusion of the first and second dyes or pigments into the substrate forms a polymeric mass in which the first and second dyes or pigments are disposed; and the carbonized region is disposed within the polymeric mass.

17. The method of claim 16, wherein the polymeric mass has a depth extending up to 0.9 mm from a surface mean of the substrate and/or an elevation extending up to 0.6 mm above the surface mean.

18. The method of claim 1, wherein each of the first and second dyes or pigments is transferred to the substrate to form a plurality of dots, each of the dots having a size selected from the range of 1 μm-10 μm to 80 μm-120 μm.

19. The method of claim 1, further comprising, after transferring the first and second dyes or pigments to the substrate and before heating the substrate, activating the green laser or the ultraviolet laser to transfer, to the substrate, a third dye or pigment from a third one of the panels or containers, the third dye or pigment in the third panel or container having a third color different from the first and second colors.

20. The method of claim 19, wherein the blackened marks and the first, second, and third dyes or pigments collectively form a CMYK color image.

21. The method of claim 1, wherein the blackened marks and the diffused first and second dyes or pigments form pixels of an image, at least some of the pixels presenting a raised texture above a surface of the substrate.

22. The method of claim 1, wherein the blackened marks are disposed on a surface of the substrate and, after diffusion of the first and second dyes or pigments, the first and second dyes or pigments are disposed in a bulk of the substrate below the surface.

* * * * *